US006599170B2

(12) United States Patent
Sone et al.

(10) Patent No.: US 6,599,170 B2
(45) Date of Patent: Jul. 29, 2003

(54) METHOD AND APPARATUS FOR POLISHING, AND LAPPING JIG

(75) Inventors: Shunsuke Sone, Kawasaki (JP); Yoshiaki Yanagida, Kawasaki (JP); Teruaki Nishioka, Kawasaki (JP); Koji Suto, Kawasaki (JP); Tomokazu Sugiyama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 107 days.

(21) Appl. No.: 09/736,003

(22) Filed: Dec. 13, 2000

(65) Prior Publication Data

US 2001/0012748 A1 Aug. 9, 2001

(30) Foreign Application Priority Data

Feb. 8, 2000 (JP) ..... 2000-030454

(51) Int. Cl.[7] ..... B24B 49/00

(52) U.S. Cl. ..... 451/5; 451/10; 451/55; 29/603.16; 29/603.17

(58) Field of Search ..... 451/5, 10, 55; 700/164; 29/603.09, 603.16, 603.17

(56) References Cited

U.S. PATENT DOCUMENTS 4,279,623 A * 7/1981 Bealle ..... 451/5
4,457,114 A * 7/1984 Hennenfent et al. ..... 451/53
4,914,868 A * 4/1990 Church et al. ..... 451/5
5,203,119 A * 4/1993 Cole ..... 451/11
5,525,091 A * 6/1996 Lam et al. ..... 451/1
5,624,298 A * 4/1997 Yumoto ..... 451/28
5,899,793 A * 5/1999 Yanagida et al. ..... 451/8
5,951,371 A * 9/1999 Hao ..... 451/28
6,045,431 A * 4/2000 Cheprasov et al. ..... 451/5
6,050,878 A * 4/2000 Kanzo et al. ..... 451/5
6,095,895 A * 8/2000 Fujita et al. ..... 451/5
6,375,539 B1 * 4/2002 Sudo et al. ..... 451/5
6,447,367 B1 * 9/2002 Kozu et al. ..... 451/5

FOREIGN PATENT DOCUMENTS

JP 10146758 6/1998

* cited by examiner

*Primary Examiner*—M. Rachuba
(74) *Attorney, Agent, or Firm*—Greer, Burns & Crain, Ltd.

(57) ABSTRACT

Disclosed herein is a method of polishing a workpiece having a plurality of resistance elements by operating a plurality of bend mechanisms to push/pull the workpiece with respect to a polishing surface. This method includes the steps of measuring a shape of the workpiece, calculating an operational amount of each bend mechanism according to the shape measured, pressing the workpiece on the polishing surface with the bend mechanisms according to the operational amount calculated, and updating the operational amount according to a working amount of the workpiece. According to this method, magnetic heads included in the workpiece can be stably polished.

11 Claims, 36 Drawing Sheets

METHOD AND APPARATUS FOR POLISHING, AND LAPPING JIG

BACKGROUND OF THE INVENTION

1. Field of the Invention

The present invention relates generally to polishing suitable for mass production of magnetic heads uniform in quality, and more particularly to a method and apparatus for polishing and a lapping jig.

2. Description of the Related Art

In a manufacturing process for a magnetic head, for example, a magnetic head thin film is formed on a substrate and next subjected to lapping (or polishing), thereby making constant the heights of a magnetic resistance layer and a gap in the magnetic head thin film. The heights of the magnetic resistance layer and the gap are required to have an accuracy on the order of submicrons. Accordingly, a lapping machine for lapping the magnetic head thin film is also required to have a high working accuracy.

FIGS. 1A and 1B illustrate a composite magnetic head in the related art. As shown in FIG. 1A, the composite magnetic head has a magnetic resistance element 2 formed on a substrate 1, and a write element 5. As shown in FIG. 1B, the magnetic resistance element 2 is composed of a magnetic resistance film 3 and a pair of conductor films 4 connected to the opposite ends of the magnetic resistance film 3. The magnetic resistance element 2 is an element whose resistance changes according to an external magnetic field. Accordingly, by using the magnetic resistance element 2, an electric current having a magnitude corresponding to the magnetization of a track T on a magnetic disk, for example, can be output to thereby allow reading of data recorded on the magnetic disk.

The magnetic resistance element 2 is capable of only reading data. Therefore, the write element 5 is additionally provided to write data as required. The write element 5 is an inductive head, for example. The write element 5 has a lower magnetic pole 6 and an upper magnetic pole 8 opposed to the lower magnetic pole 6 with a gap defined therebetween. A coil 7 is provided between the lower magnetic pole 6 and the upper magnetic pole 8 to excite these magnetic poles 6 and 8. The coil 7 is surrounded by a nonmagnetic insulating layer 9.

In such a composite magnetic head, it is desirable to make constant the resistance of the magnetic resistance film 3 of the magnetic resistance element 2. However, it is difficult to make the resistance constant only in a manufacturing process for the thin film of the magnetic head. Accordingly, after forming the thin film of the magnetic head, it is machined so that the height (width) h of the magnetic resistance film 3 becomes constant, thus obtaining a constant resistance.

FIGS. 2A to 2C and 3A to 3D illustrate a manufacturing process for the composite magnetic head shown in FIGS. 1A and 1B.

As shown in FIG. 2A, a set of many row bars 11 each having a plurality of composite magnetic heads 12 (see FIG. 2B) are formed on a wafer 10 by a thin-film technique. In the next step, the wafer 10 is cut into many rectangular parts to thereby separate the above set into the row bars 11 as workpieces. As shown in FIG. 2B, each row bar 11 has a plurality of magnetic heads 12 and three resistance elements 12*a* for monitoring of lapping. These magnetic heads 12 and resistance elements 12*a* are arranged in a line. For example, the resistance elements 12*a* are positioned at the left end, center, and right end of the row bar 11.

Each row bar 11 having the plural magnetic heads 12 is next subjected to lapping so that the height of the magnetic resistance film 3 in each head becomes constant as mentioned above. However, since the row bar 11 is as thin as 0.3 mm, for example, it is difficult to mount the row bar 11 directly on a lapping machine. Accordingly, as shown in FIG. 2C, the row bar 11 is temporarily bonded to a row tool 13 as a lapping jig by means of a hot-melt wax.

In the next step, the row bar 11 bonded to the row tool 13 is lapped on a lap plate (or polish plate) 14 as shown in FIG. 3A. In this lapping operation, the resistance of each resistance element 12*a* of the row bar 11 is measured at all times as known from Japanese Patent Laid-open No. 2-124262 (U.S. Pat. No. 5,023,991) and Japanese Patent Laid-open No. 5-123960, for example. Then, whether or not the height of the magnetic resistance film of each magnetic head 12 has become a target value is detected according to the measured resistance of each resistance element 12*a*.

At the time it is detected that the magnetic resistance film has been lapped up to the target height, according to the measured resistance, the lapping operation is stopped. Thereafter, as shown in FIG. 3B, a slider is formed on a lower surface 11-1 of the row bar 11.

In the next step, the row bar 11 is cut into the plural magnetic heads 12 in the condition that it is bonded to the row tool 13 as shown in FIG. 3C. In the next step, the row tool 13 is heated to melt the hot-melt wax, thereby removing the magnetic heads 12 from the row tool 13 to obtain the individual magnetic heads 12.

In this manner, the row bar 11 having the plural magnetic heads 12 arranged in a line is first prepared, and next subjected to lapping, so that the magnetic resistance films 3 of the plural magnetic heads 12 can be lapped at a time.

However, there are variations in height among the magnetic resistance films 3 of the plural magnetic heads 12 in the row bar 11 on the order of submicrons, depending on a mounting accuracy, film forming accuracy, etc. It is accordingly necessary to correct for such variations in the lapping operation for mass production of magnetic heads uniform in characteristics.

In this respect, it is known that a hole is formed through the row tool 13 at a position near a work surface to which the row bar 11 is bonded, and that a force is applied from an actuator through this hole to the row tool 13, thereby producing a desired pressure distribution between the row bar 11 and a lapping surface of the lap plate 14. However, since the hole of the row tool 13 is singular, the variations cannot be reduced and it is difficult to obtain a high working accuracy.

To cope with this problem, it has been proposed to form a plurality of holes through the row tool 13 and respectively apply forces from actuators through these holes to the row tool 13 as described in U.S. Pat. No. 5,607,340. However, these actuators are required to have capacities of applying relatively large forces to these holes, in order to obtain a desired pressure distribution, and it is therefore difficult to manufacture such actuators acting on a plurality of load points (or operation points). As a result, the spacing between any adjacent ones of the plural load points (the plural holes) cannot be greatly reduced, yet causing a difficulty of improvement in working accuracy.

Further, in polishing magnetic heads, a working accuracy on the order of submicrons is required from the viewpoint of the property of the workpiece. The following items may be considered to maintain a high accuracy always stably, provided that mass production is carried Out.

(1) Working control hardly depending on shape characteristics of the workpiece and external factors.

(2) Working control with a reduced load on the workpiece itself.

(3) Working control less susceptible to an unexpected accident such as abnormality of monitor elements.

SUMMARY OF THE INVENTION

It is therefore an object of the present invention to provide a method and apparatus for polishing and a lapping jig suitable for improvement in working accuracy.

In accordance with an aspect of the present invention, there is provided a method of polishing a workpiece having a plurality of resistance elements by operating a plurality of bend mechanisms to push/pull said workpiece with respect to a polishing surface, comprising the steps of measuring a shape of said workpiece; calculating an operational amount of each of said bend mechanisms according to said shape measured; pressing said workpiece on said polishing surface with said bend mechanisms according to said operational amount calculated; and updating said operational amount according to a working amount of said workpiece.

In accordance with another aspect of the present invention, there is provided an apparatus comprising a polish plate for providing a polishing surface; a plurality of bend mechanisms for pressing a workpiece on said polishing surface; shape measuring means for measuring a shape of said workpiece; and control means for calculating an operational amount of each of said bend mechanisms according to said shape measured; and updating said operational amount according to a working amount of said workpiece.

In accordance with a further aspect of the present invention, there is provided a lapping jig on which a workpiece having a plurality of magnetic heads and a plurality of resistance elements is to be mounted, comprising a work surface for pressing said workpiece against a polishing surface; a plurality of displacing portions arranged along said work surface and respectively having a plurality of holes; a first columnar structure for supporting each of said displacing portions to a portion on the side of said work surface; a second columnar structure for connecting adjacent ones of said displacing portions; and a third columnar structure for supporting said second columnar structure to another portion opposite to said portion on the side of said work surface.

In the method according to the present invention, the shape of the workpiece is first measured. Thereafter, calculation is made on an optimum operational amount for polishing of the workpiece so that the heights of magnetic heads included in the workpiece together with the resistance elements become uniform, according to the measured shape of the workpiece. Then, each bend mechanism is operated according to the calculated operational amount to push/pull the workpiece with respect to the polishing surface, thus polishing the magnetic heads and the resistance elements. The operational amount of each bend mechanism is updated according to a working amount of the workpiece.

According to this method, the operational amount of each bend mechanism is updated at the time a given working amount is reached, according to the working amount of the workpiece, i.e., an actually polished amount. Accordingly, at the time of updating the operational amount, an effect of shape correction (bend) given at the previous time has already been obtained. That is, a given time period varying according to circumstances is required from the time the operational amount is applied to each bend mechanism to the time the workpiece is polished into an intended shape. Accordingly, excess bend can be prevented according to the method of the present invention, thereby allowing stable working control with no fluctuations to improve the working accuracy.

The operational amount of each bend mechanism may be increased or decreased by a predetermined unit amount, so as to prevent partial polishing due to application of a large deformation at a time. The unit amount may be decided according to a difference between an updated value of the operational amount and an unupdated value of the operational amount. Further, the unit amount may be made different at each operation point according to the displacement by a load applied to each operation point, depending on structural characteristics of an actual lapping jig. Further, the unit amount may be weighted according to the direction of the load at each operational point. Further, the unit amount may be changed according to a working history.

The method according to the present invention may further comprise the step of performing simulation on the working to the workpiece. In this case, abnormality of a working apparatus including the bend mechanisms may be detected according to the result of the simulation, e.g., according to a difference between the result of the simulation and an actual working amount.

In the step of measuring the shape of the workpiece, the heights of the resistance elements may be measured from the resistances of the resistance elements. In this case, the operational amount of each bend mechanism may be calculated according to the measured height of each resistance element. For example, calculation may be made on a difference between the height of a certain one of the resistance elements and the average of the heights of the two resistance elements adjacent to the certain resistance element. Further, when this difference is greater than a predetermined value, the height of the certain resistance element may be replaced by a value calculated by spline interpolation.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Some preferred embodiments of the present invention will now be described in detail with reference to the drawings.

Figure 1A:
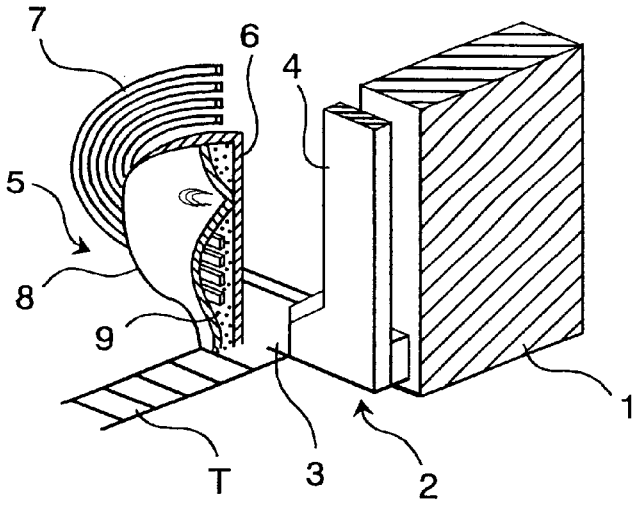
FIG. 1A PRIOR ART
FIGS. 1A and 1B are a partially-cutaway perspective view and an elevational view of a composite magnetic head in the related art.
Figure 1B:
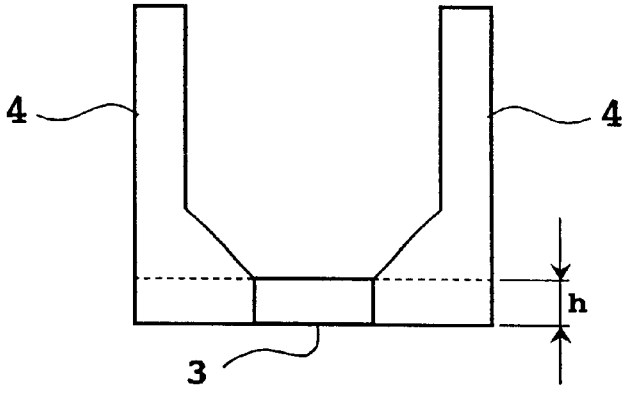
FIG. 1B PRIOR ART
Figure 2A:
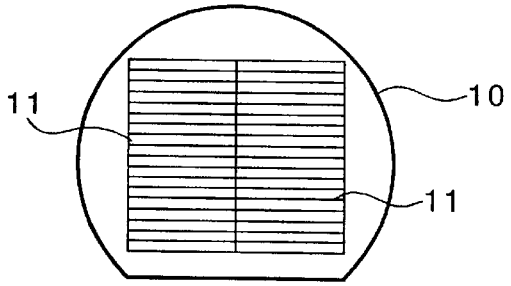
FIG. 2A PRIOR ART
FIGS. 2A to 2C and 3A to 3D are illustrations of a manufacturing process for the composite magnetic head shown in FIGS. 1A and 1B.
Figure 2B:
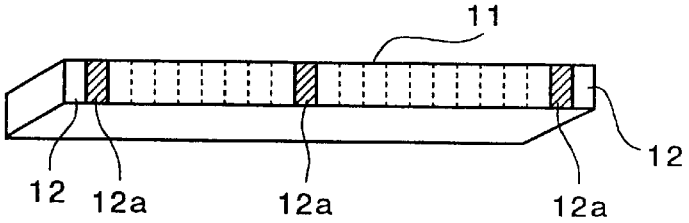
FIG. 2B PRIOR ART
Figure 2C:
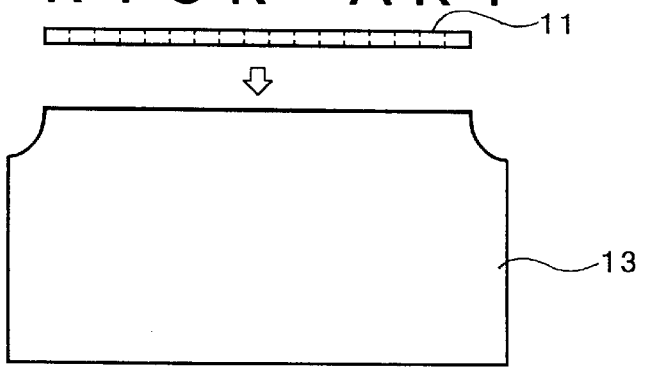
FIG. 2C PRIOR ART
Figure 3A:
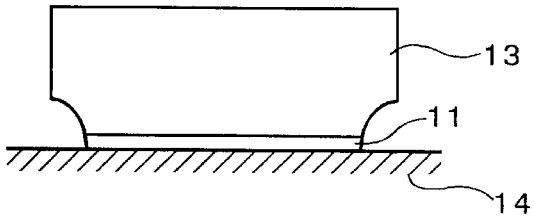
FIG. 3A PRIOR ART
Figure 3B:
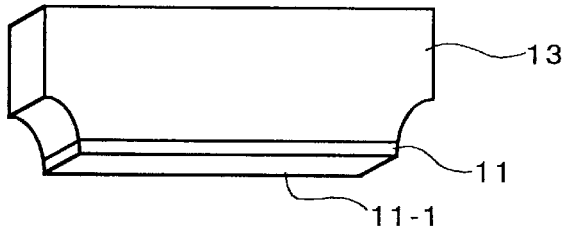
FIG. 3B PRIOR ART
Figure 3C:
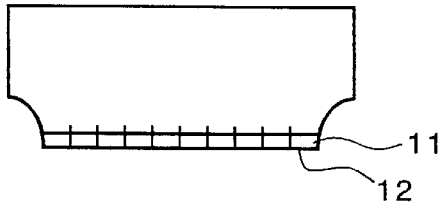
FIG. 3C PRIOR ART
Figure 3D:
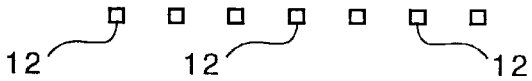
FIG. 3D PRIOR ART
Figure 4:
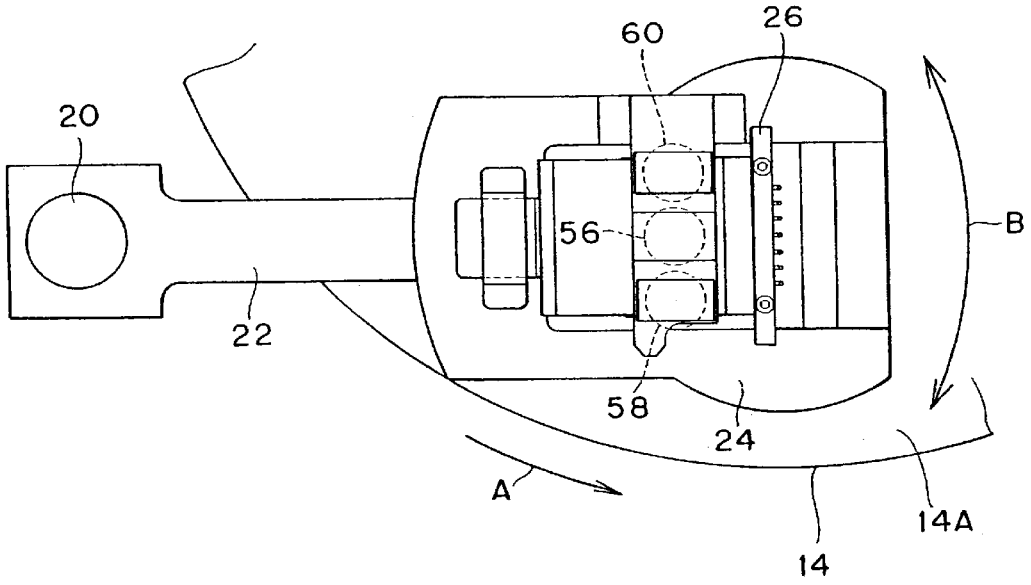
FIG. 4 is a plan view of a lapping machine to which the present invention is applicable.
Figure 5:
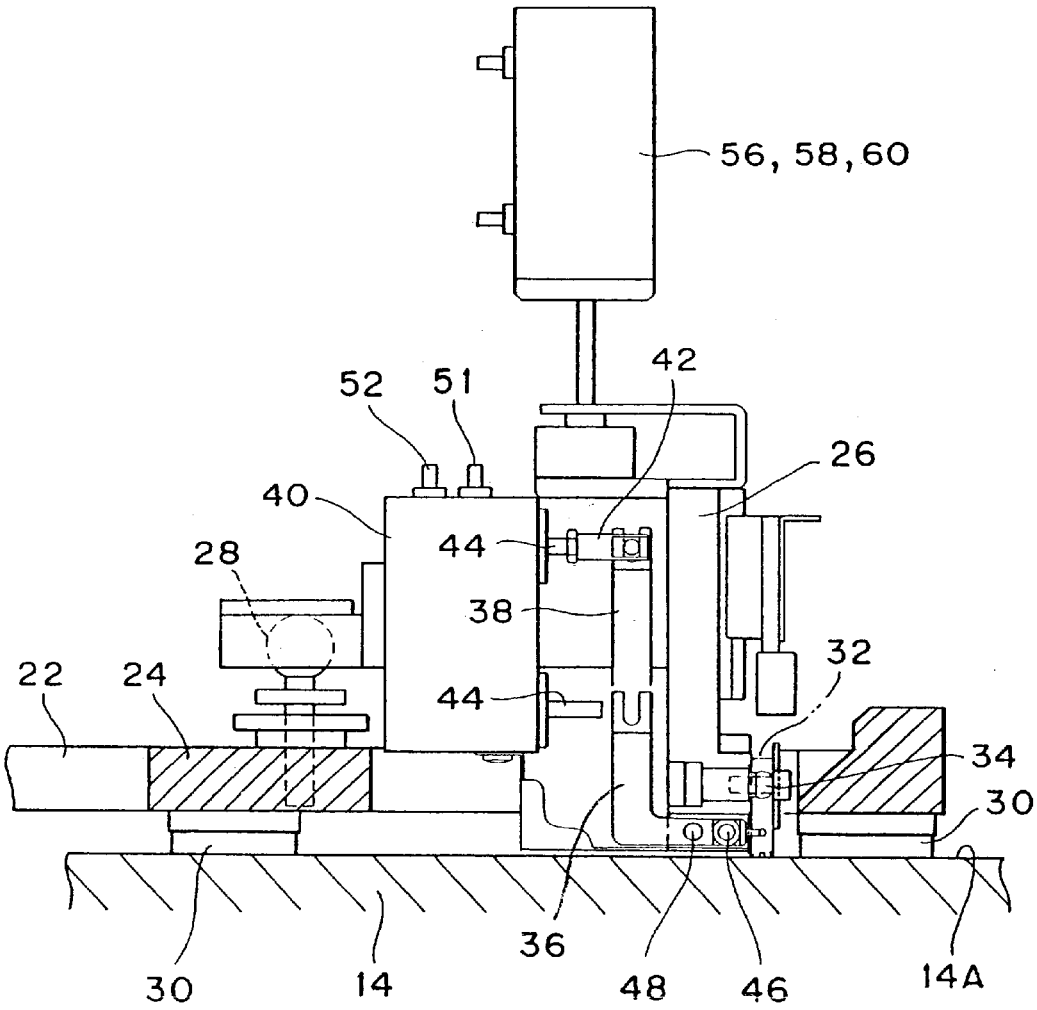
FIG. 5 is a partially-cutaway side view of the lapping machine shown in FIG. 4.
Figure 6:
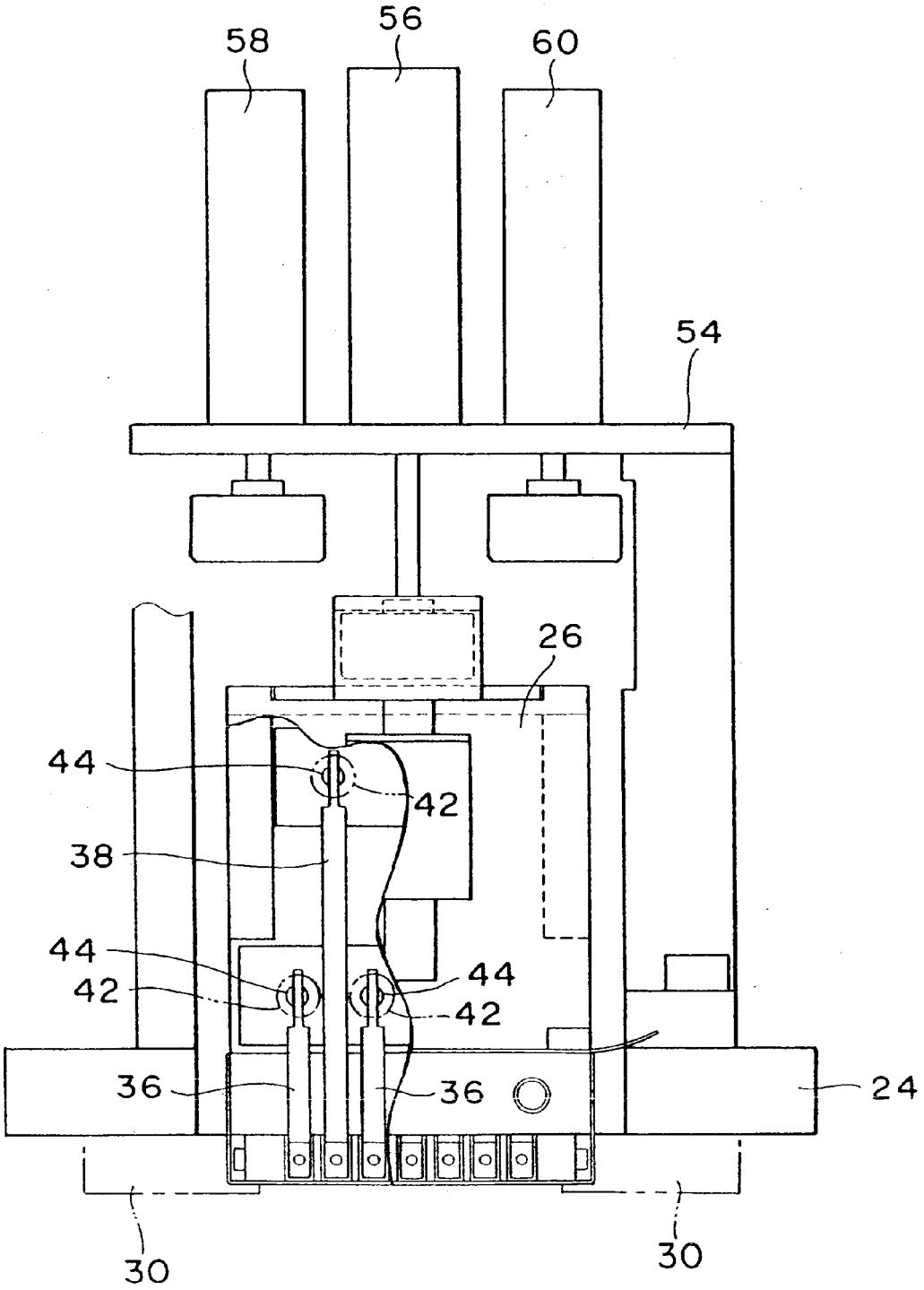
FIG. 6 is a partially-cutaway elevational view of the lapping machine shown in FIG. 4.

FIGS. 4, 5, and 6 are a plan view, partially-cutaway side view, and partially-cutaway elevational view, respectively, showing a preferred embodiment of a lapping machine to which the present invention is applicable.

As shown in FIG. 4, a lap plate (polish plate) 14 for providing a lapping surface (polishing surface) 14A is rotated in a direction of arrow A by a motor (not shown). A lap base 24 is pivotably supported through an arm 22 to a pivot shaft 20 fixed to the lapping machine, so that the lap base 24 is pivotally moved about the pivot shaft 20 in a direction of arrow B by a drive mechanism (not shown) in lapping.

As shown in FIG. 5, an adapter 26 is supported at one point by a ball 28 fixed to the lap base 24. A plurality of (e.g., four in this preferred embodiment) feet 30 are provided on the lower surface of the lap base 24. The feet 30 slide on the lapping surface 14A. A row tool 32 as a lapping jig is mounted at a lower portion of the adapter 26.

Figure 7:
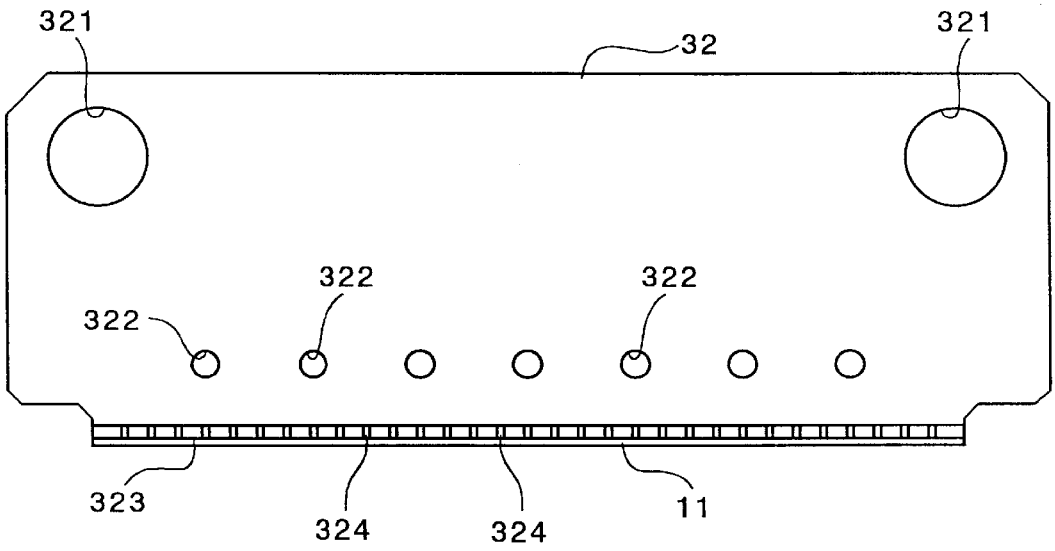
FIG. 7 is an elevational view of a row tool applicable to the present invention.

Referring to FIG. 7 showing the row tool 32 in elevation, the row tool 32 has a pair of holes 321 formed to mount the row tool 32 to the adapter 26, a plurality of (e.g., seven in this preferred embodiment) holes 322 formed to effect elastic deformation of the row tool 32 by means of a mechanism to be hereinafter described, and a work surface 323 to which a row bar 11 as a workpiece is to be bonded by means of a hot-melt wax, for example. The work surface 323 is formed with a plurality of grooves 324 for use in dicing the row bar 11. The holes 322 arranged at equal intervals along the work surface 323.

Referring to FIG. 5, a pair of projections 34 provided on the adapter 26 are inserted through the holes 321 of the row tool 32, thereby mounting the row tool 32 on the adapter 26. The row bar 11 is pressed against the lapping surface 14A by the work surface 323 of the row tool 32, because the adapter 26 is supported at one point by the ball 28. To produce a given pressure distribution between the row bar 11 and the lapping surface 14A, this preferred embodiment employs four short links 36, three long links 38, and an air cylinder 40. Each of the links 36 and 38 is connected through a connector 42 to a cylinder rod 44 of the air cylinder 40.

Figure 8:
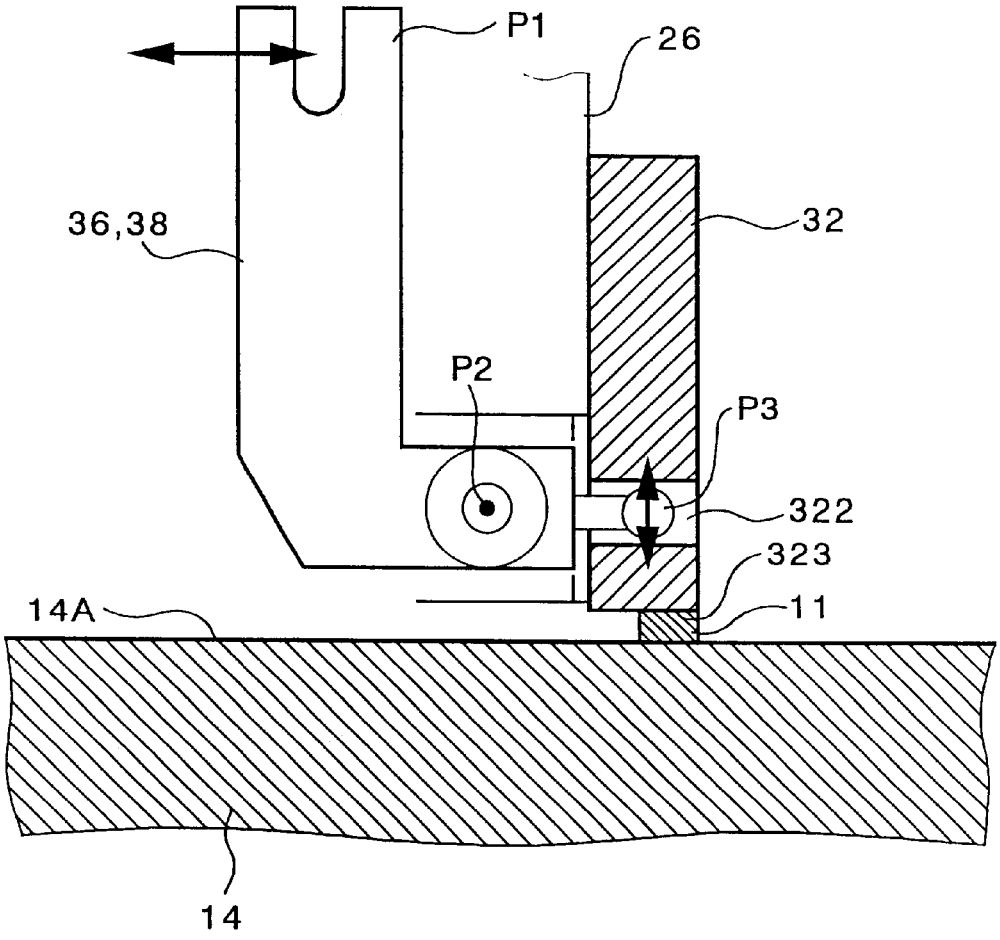
FIG. 8 is a schematic sectional side view for illustrating the operation of long links and short links shown in FIG. 5.

FIG. 8 is a schematic sectional side view for illustrating the operation of the short links 36 and the long links 38. Each of the short links 36 and the long links 38 has an effort point P1 where a force is received in a direction substantially parallel to the work surface 323 from the corresponding cylinder rod 44, a support point P2 as the fulcrum or the center of pivotal movement of each link, and a load point P3 where a force is applied to the row tool 32 inside the corresponding hole 322 in a direction substantially perpendicular to the work surface 323. For example, when the cylinder rod 44 is pushed to displace the effort point P1 rightward as viewed in FIG. 8, the load point P3 is displaced downward as viewed in FIG. 8, thereby increasing the force pressing the row bar 11 against the lapping surface 14A. Conversely, when the cylinder rod 44 is drawn to displace the effort point P1 leftward as viewed in FIG. 8, the load point P3 is displaced upward as viewed in FIG. 8, thereby decreasing the force pressing the row bar 11 against the lapping surface 14A or increasing a force retracting the row bar 11 from the lapping surface 14A.

Figure 9:
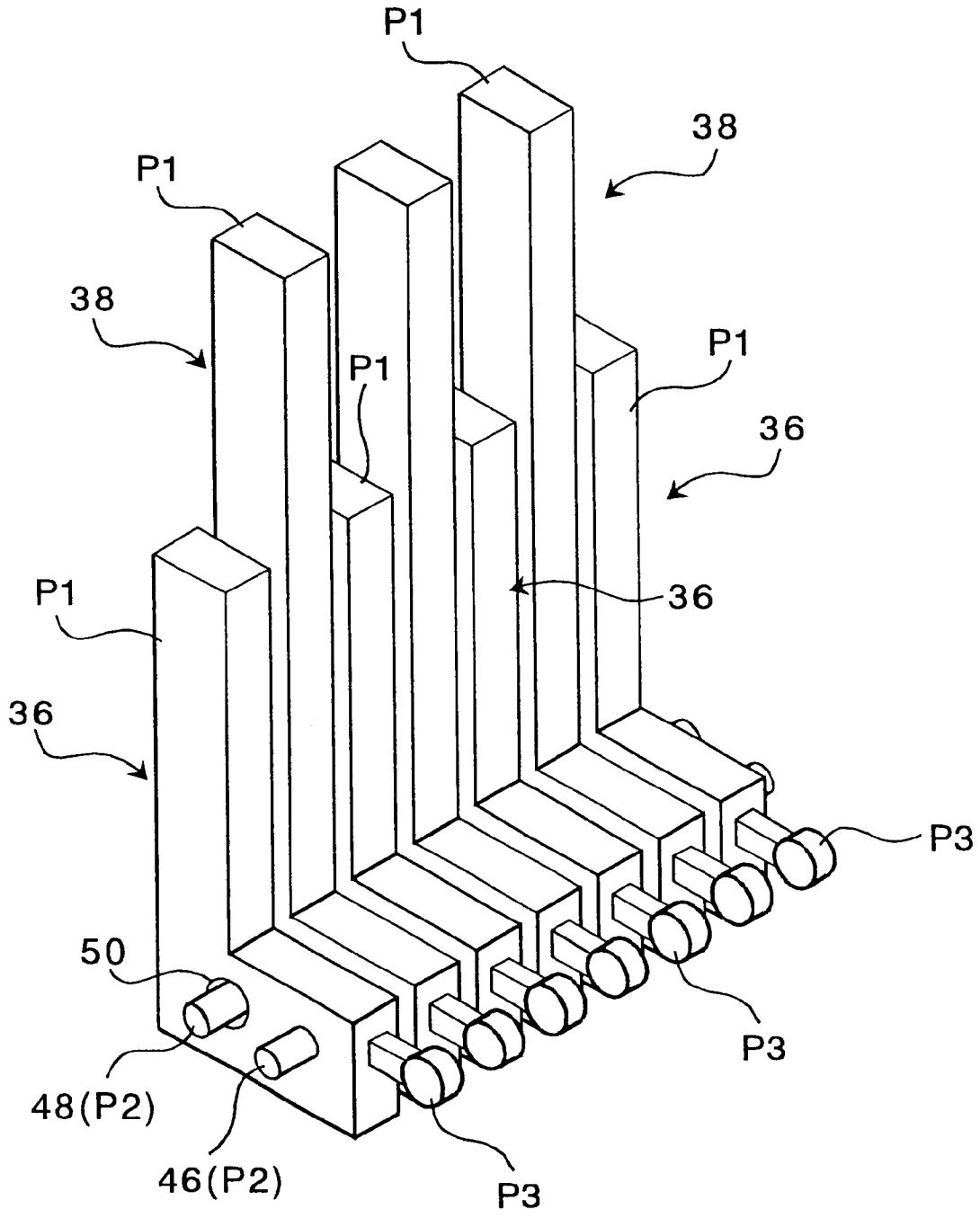
FIG. 9 is a perspective view of the long links and the short links shown in FIG. 5.

Referring to FIG. 9, the short links 36 and the long links 38 are alternately arranged. The support point P2 of each short link 36 is provided by a shaft 46 for pivotably supporting each short link 36. The support point P2 of each long link 38 is provided by a shaft 48 for pivotably supporting each long link 38. The distance between the support point P2 and the load point P3 of each short link 36 is shorter than the distance between the support point P2 and the load point P3 of each long link 38. Accordingly, the shaft 46 is positioned between the shaft 48 and the load point P3. Each short link 36 has a hole 50 through which the shaft 48 is loosely inserted so that the pivotal movement of this short link 36 is allowed. Similarly, each long link 38 has a hole (not shown) through which the shaft 46 is loosely inserted so that the pivotal movement of this long link 38 is allowed. The shafts 46 and 48 are fixed to the adapter 26.

Figure 10A:
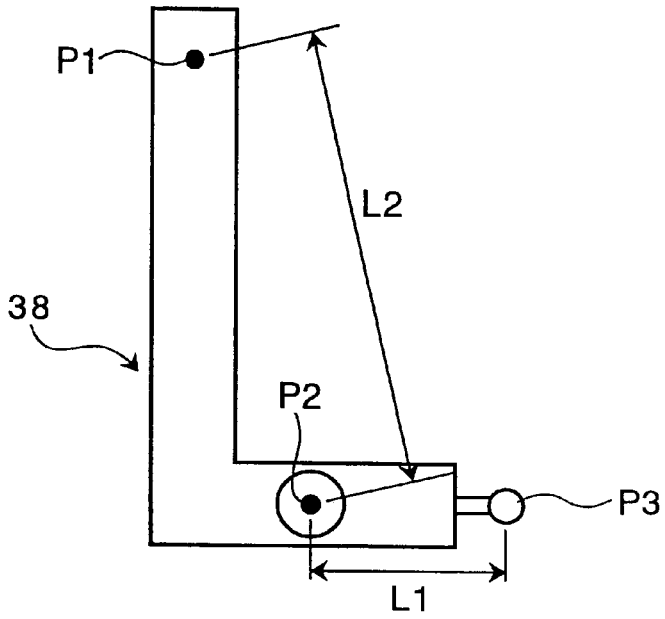
FIGS. 10A and 10B are schematic side views showing an example of the design of each long link and each short link shown in FIG. 5.
Figure 10B:
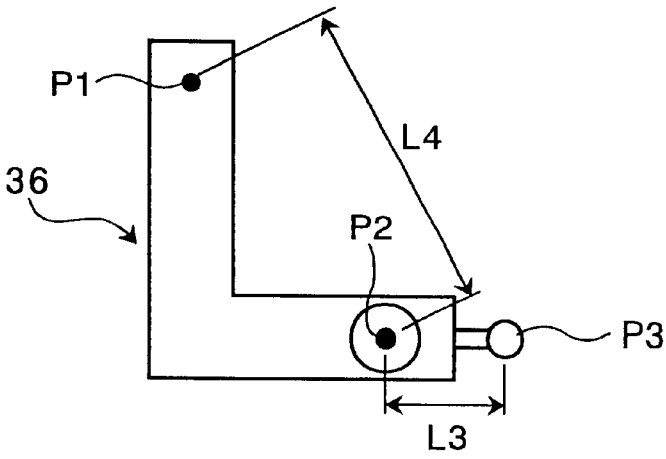

FIGS. 10A and 10B are schematic side views showing an example of the design of each long link 38 and each short link 36, respectively. As shown in FIG. 10A, the distance between the support point P2 and the load point P3 in each long link 38 is set to L1, and the distance between the support point P2 and the effort point P1 in each long link 38 is set to L2. As shown in FIG. 10B, the distance between the support point P2 and the load point P2 in each short link 36 is set to L3 (L3<L1), and the distance between the support link P2 and the effort point P1 in each short link 36 is set to L4 (L4<L2). In this preferred embodiment, the relation of L2/L1=L4/L3 is satisfied.

Figure 11:
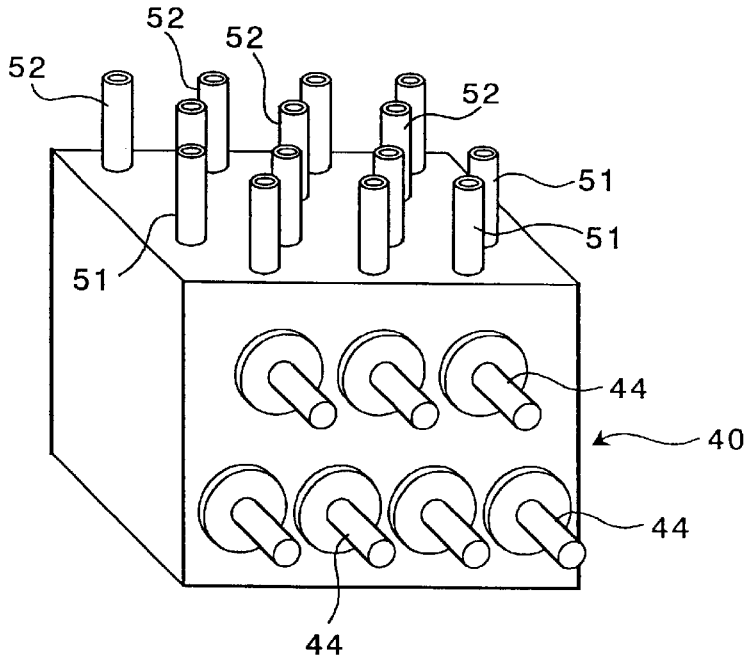
FIG. 11 is a perspective view of an air cylinder shown in FIG. 5.

In the combination of the short links 36 and the long links 38 as shown in FIG. 9, a straight line formed by connecting the four effort points P1 of the short links 36 is different in position from a straight line formed by connecting the three effort points P1 of the long links 38. Accordingly, the air cylinder 40 can be configured as shown in FIG. 11 in such a manner that the seven cylinder rods 44 are zigzag arranged. Each cylinder rod 44 is controlled by a pair of air tubes 51 and 52. In the case that the air tube 51 is connected to a positive pressure source and the air tube 52 is connected to a negative pressure source, the corresponding cylinder rod 44 is drawn into the air cylinder 40. Conversely, in the case that the air tube 51 is connected to a negative pressure source and the air tube 52 is connected to a positive pressure source, the corresponding cylinder rod 44 is pushed out of the air cylinder 40.

Since the above-mentioned relation L2/L1=L4/L3 is satisfied in this preferred embodiment, the forces required at the effort points P1 of each short link 36 and each long link 38 can be made equal, so as to produce the forces of the same magnitude at the load points P3 of each short link 36 and each long link 38. Further, by zigzag arranging the cylinder rods 44 as shown in FIG. 11, the spacing between each short link 36 and each long link 38 adjacent thereto can be reduced as ensuring a sufficiently large force to be given by each cylinder rod 44, thereby improving a working accuracy.

Referring again to FIG. 6, a pressure cylinder 56 and a pair of balance cylinders 58 and 60 are provided on a table 54 fixed to the lap base 24. The pressure cylinder 56 functions to press the upper surface of the adapter 26 at its substantially central portion, so as to apply a uniform pressure to the row tool 32. The use of the pressure cylinder 56 provides an advantage such that it is sufficient for the air cylinder 40 to have a capacity enough to produce a deviation in a required pressure distribution. Accordingly, the capacity of the air cylinder 40 can be reduced.

The balance cylinders 58 and 60 function to press the upper surface of the adapter 26 at its left and right end portions, respectively, as viewed in FIG. 6, so as to correct for the imbalance of the pressure applied to the row tool 32 in its longitudinal direction. The use of the balance cylinders 58 and 60 also provides an advantage similar to that provided by using the pressure cylinder 56, so that the capacity of the air cylinder 40 can be reduced.

Figure 12:
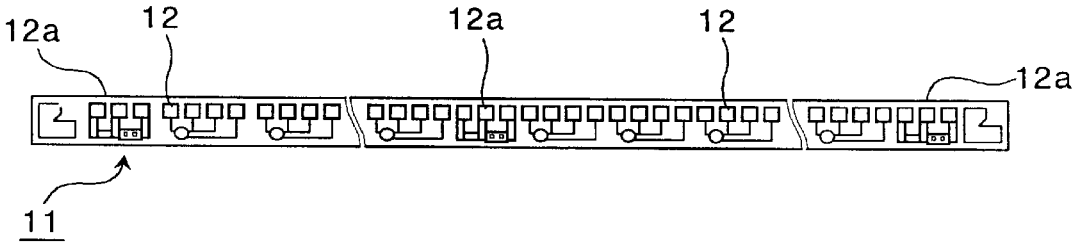
FIG. 12 is an elevational view of a row bar applicable to the present invention.

As shown in FIG. 12, the row bar 11 has a plurality of magnetic heads 12 and a plurality of resistance elements (ELG elements where ELG is an abbreviation of Electrical Lapping Guide) 12*a* formed to monitor a lapping operation. In this preferred embodiment, the ELG elements 12*a* are provided at three positions, or at the left end, the center, and the right end of the row bar 11.

The resistance of the ELG element 12*a* corresponds to the height of the ELG element 12*a*. The relation between the resistance Ra of the ELG element 12*a* and the height h of the ELG element 12*a* is approximated by the following equation.

$$Ra=a/h+b$$

where a and b stand for the coefficients that can be preliminarily obtained by experiment.

By using this equation with the coefficients a and b defined, the resistance Ra is converted into the height h of the ELG element 12*a*. In this manner, by measuring the resistance of the ELG element 12*a*, the height of the ELG element 12*a* or the magnetic head can be obtained. Accordingly, whether or not the height of the ELG element 12*a* has reached a target value can be determined. At the time the height of the ELG element 12*a* has reached the target value, the lapping operation is stopped.

While the row bar 11 has the three ELG elements 12*a* as shown in FIG. 12, it is preferable to use a larger number of (e.g., 31) ELG elements 12*a* in order to independently control the seven links 36 and 38 as in this preferred embodiment. In lapping, the pressure distribution to be produced between the row bar 11 and the lapping surface 14A is set so that the resistances of all the ELG elements 12*a* become uniform. Such setting of the pressure distribution may be made by feedback control each of the links 36 and 38 according to the measured resistance of each ELG element 12*a*. Alternatively, an operating amount of each of the links 36 and 38 may be obtained by calculation from the resistance of each ELG element 12*a* to set the pressure distribution between the row bar 11 and the lapping surface 14A by feedforward control. Further, the control of pressures to be applied to the adapter 26 may be made by feedback control or feedforward control according to the measured resistance of each ELG element 12*a*. Such working control will now be described more specifically.

Figure 13:
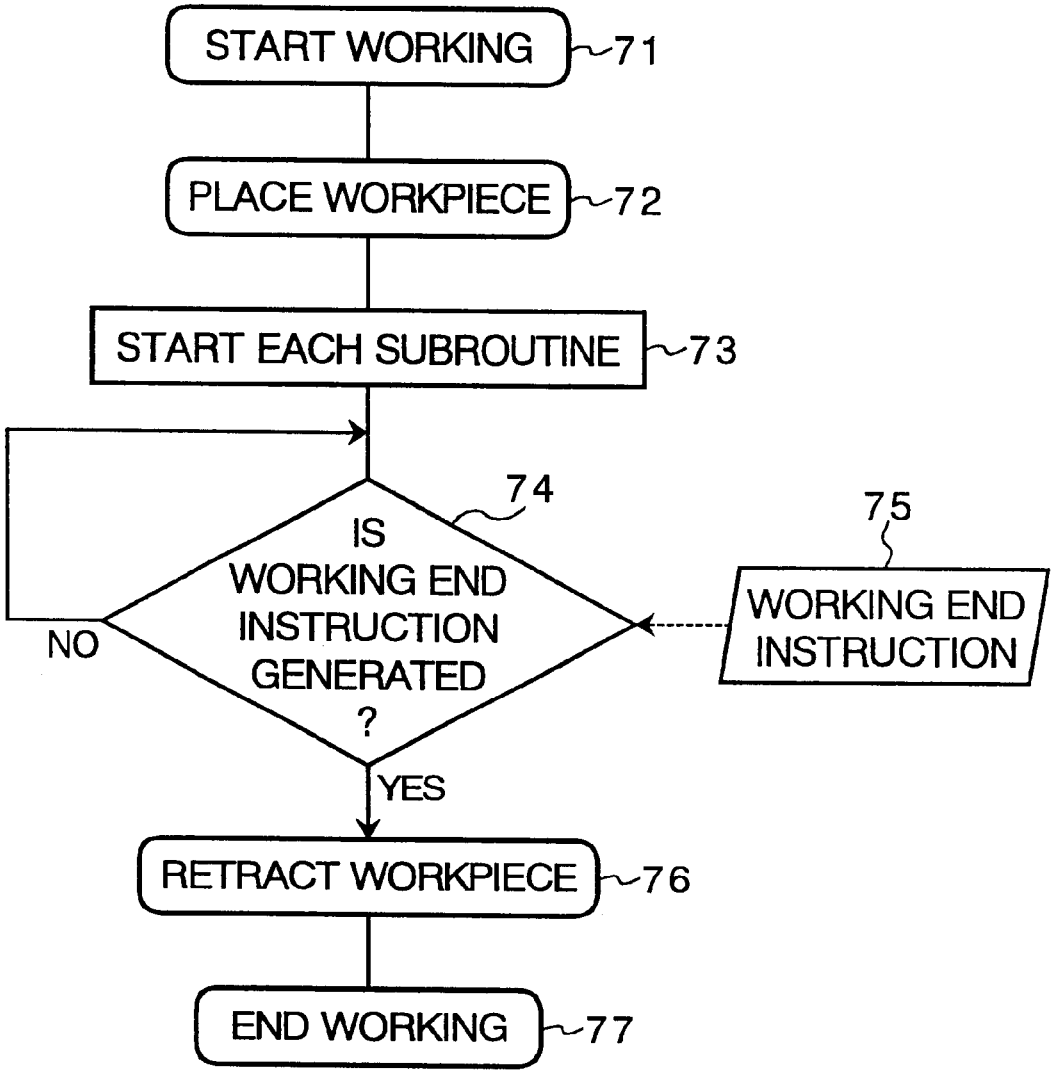
FIG. 13 is a flowchart showing a main routine of the working control according to the present invention.

FIG. 13 is a flowchart showing a main routine of the working control. When a working start command is entered in step 71, the workpiece, or the row bar 11 is placed on the lapping surface 14A of the lap plate 14 in step 72, and each subroutine to be hereinafter described is started in step 73. In step 74, it is determined whether or not a working end instruction has been generated according to data on the working end instruction shown by reference numeral 75. If the working end instruction has been generated, the program proceeds to step 76, in which the workpiece is retracted from the lapping surface 14A of the lap plate 14. Thereafter, the working end is confirmed in step 77.

Thus, the main routine of the working control is provided and the working is stopped in accordance with the working end instruction from another routine. Accordingly, a plurality of workpieces can be machined simultaneously by associating a plurality of working mechanism sections (e.g., the arm 22 etc. shown in FIG. 4) with a single lap plate.

Figure 14:
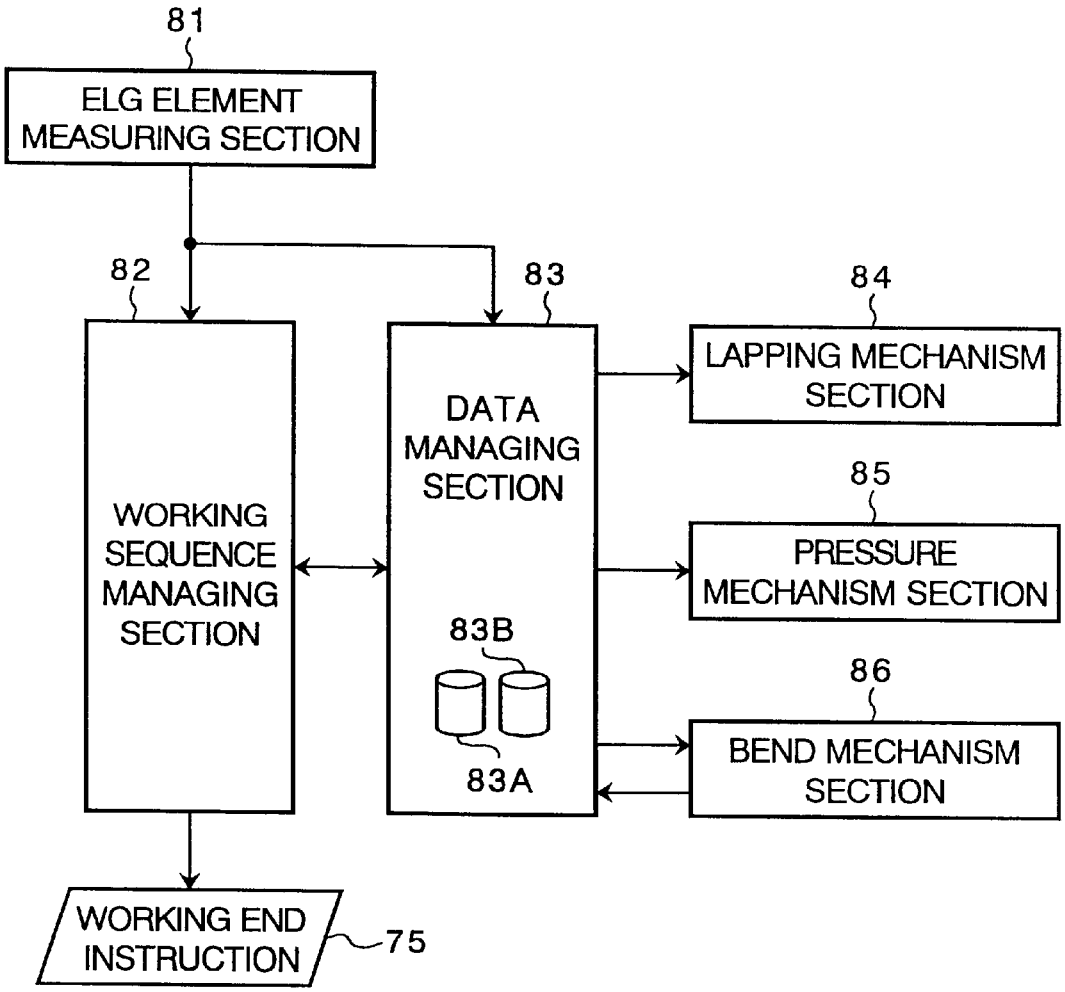
FIG. 14 is a block diagram showing the configuration of a control system according to the present invention.

Referring to FIG. 14, there is shown the configuration of a control system for the working control characteristic of this preferred embodiment. This control system includes an ELG element measuring section 81, a working sequence managing section 82, a data managing section 83, a lapping mechanism section 84, a pressure mechanism section 85, and a bend mechanism section 86. The data managing section 83 includes a first data table 83A relating to a working record (log) and a second data table 83B relating to working sequence data. The data 75 relating to the working end instruction (see FIG. 13) is output from the working sequence managing section 82.

There will now be described in detail the content of the subroutine in each section and the exchange of data between the sections.

Figure 15:
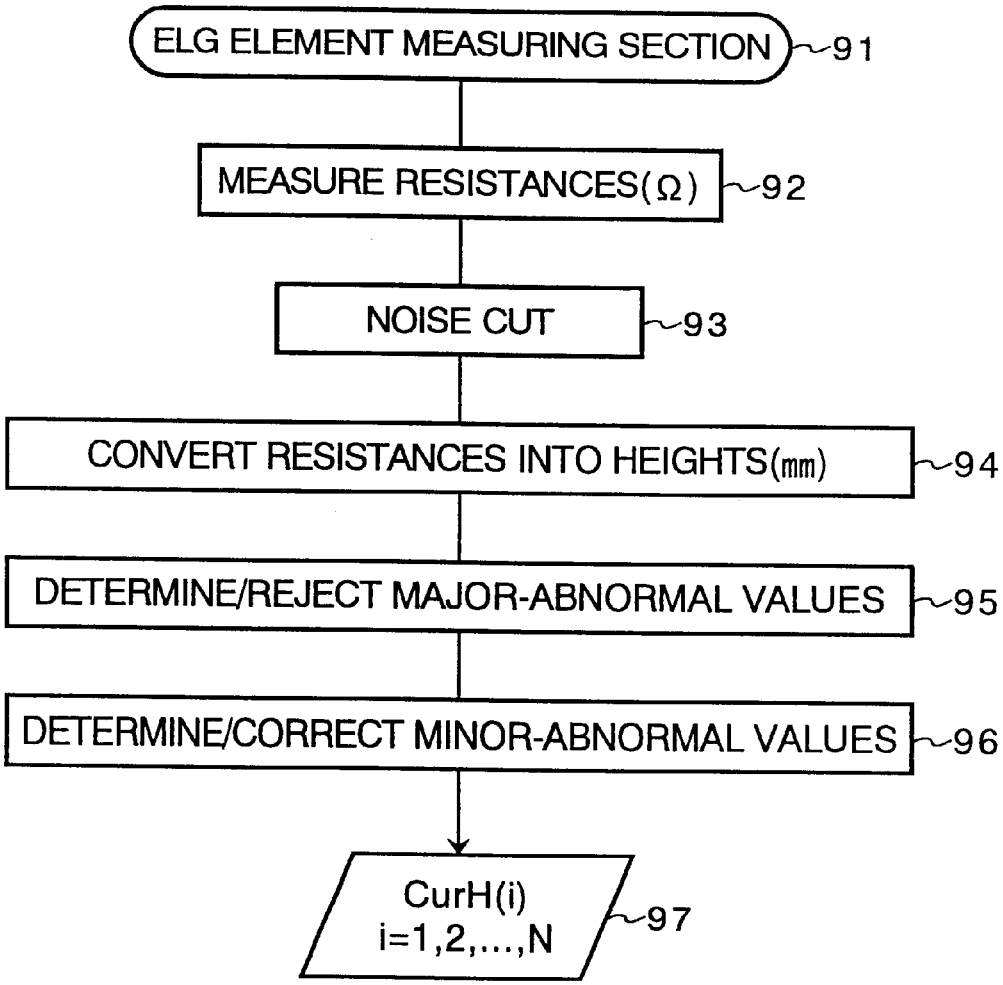
FIG. 15 is a flowchart showing a subroutine in an ELG element measuring section of the control system.

FIG. 15 is a flowchart showing the subroutine in the ELG element measuring section 81. When the subroutine in the ELG element measuring section 81 is started in step 91, the resistance (Ω) of each ELG element 12*a* is measured in step 92. Thereafter, noise cut relating to the measured values is performed in step 93, and the measured resistance of each ELG element 12*a* is converted into the height (mm) of each ELG element 12*a* or each magnetic head 12 in step 94. Thereafter, in step 95, determination/rejection of major-abnormal values is performed according to the heights obtained in step 94. In step 96, determination/correction of minor-abnormal values is performed according to the heights obtained in step 94. The processings of steps 95 and 96 will be hereinafter described more specifically. Thus, the present height "CurH(i)" (i=1, 2, . . . , N) of each ELG element 12*a* is obtained as data, in which N is the number of the ELG elements 12*a*. Data 97 on "CurH(i)" is supplied to the working sequence managing section 82 and the first data table 83A of the data managing section 83.

Figure 16:
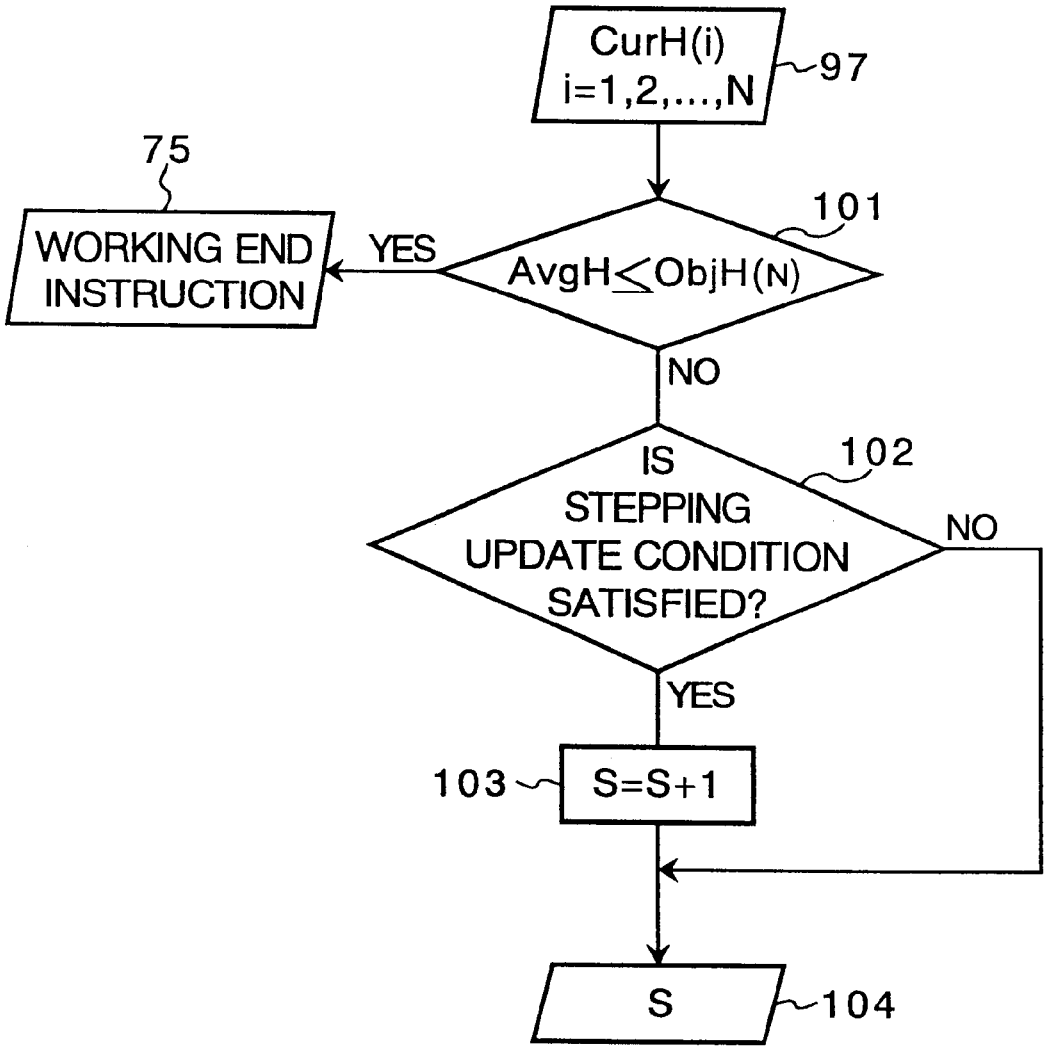
FIG. 16 is a flowchart showing a subroutine in a working sequence managing section of the control system.

FIG. 16 is a flowchart showing the subroutine in the working sequence managing section 82. When the data 97 on "CurH(i)" is supplied from the ELG element measuring section 81 to the working sequence managing section 82, it is determined whether or not the average "AvgH" of the heights of the ELG elements 12*a* is less than or equal to a working end height "ObjH" in step 101. If "AvgH" is less than or equal to "ObjH", the data 75 on the working end instruction is output, whereas if "AvgH" is greater than "ObjH", the program proceeds to step 102. In step 102, it is determined whether or not a stepping update condition is satisfied. If the stepping update condition is not satisfied, data on stepping "s" at this time is output as shown by reference numeral 104. If the stepping update condition is satisfied in step 102, the program proceeds to step 103, in which the present stepping "s" is updated to "s+1". Then, data on the updated stepping "s" is output as shown by reference numeral 104. The data 104 on the stepping "s" is supplied to the second data table 83B of the data managing section 83. The stepping "s" is defined as a state where lapping is run under certain fixed conditions.

Figure 17:
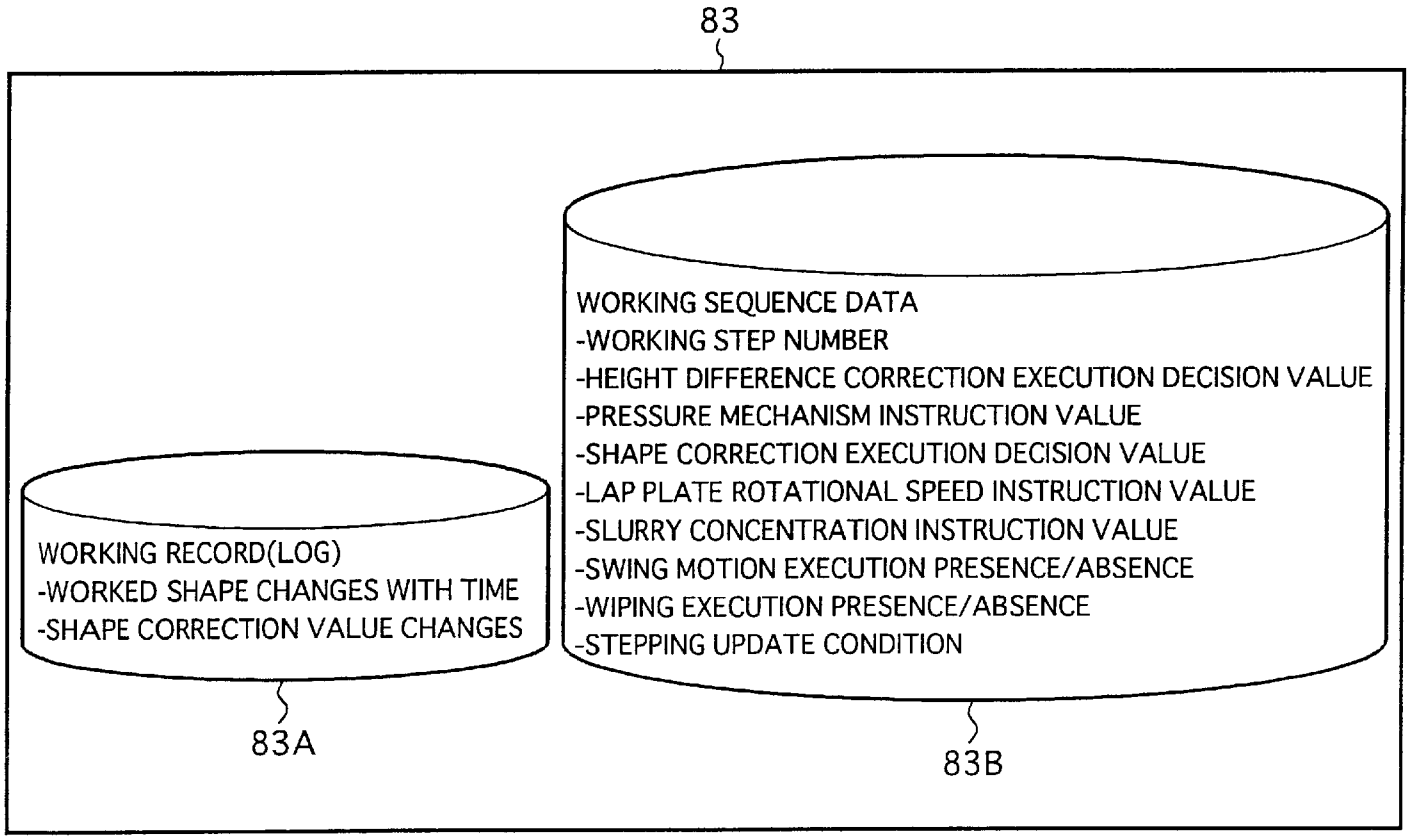
FIG. 17 is a diagram showing the details of a data managing section of the control system.

FIG. 17 is a diagram showing the details of the data managing section 83. The data managing section 83 includes the first data table 83A relating to a working record (log) and the second data table 83B relating to working sequence data. The first data table 83A stores data relating to a working record (log), which data includes worked shape changes with time and shape correction (bend) value changes. On the other hand, the working sequence data is stored in the second data table 83B and includes a working step number (stepping) "s", height difference correction execution decision value, pressure mechanism instruction value, shape correction (bend) execution decision value, lap plate rotational speed instruction value, slurry concentration instruction value, swing motion execution presence/absence, and stepping update condition. The stepping update condition is data to be returned to the working sequence managing section 82.

Figure 18:
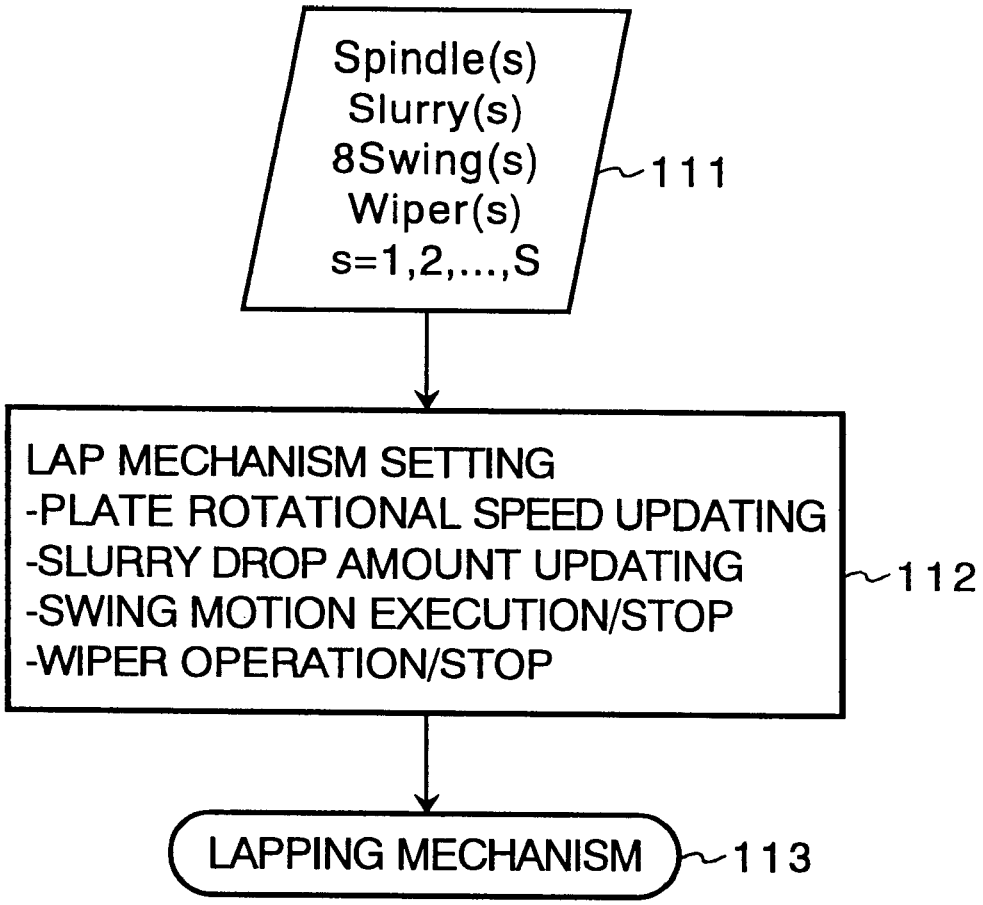
FIG. 18 is a flowchart showing a subroutine in a lapping mechanism section of the control system.

FIG. 18 is a flowchart showing the subroutine in the lapping mechanism section 84. As shown by reference numeral 111, the data to be supplied from the second data table 83B of the data managing section 83 to the lapping mechanism section 84 includes a lap plate rotational speed instruction value "Spindle(s)" in the stepping "s", slurry concentration instruction value "Slurry(s)" in the stepping "s", swing motion execution presence/absence "8Swing(s)" in the stepping "s", and wiping execution presence/absence "Wiper(s)" in the stepping "s" (s=1, 2, . . . , S), in which S is the total stepping number (the total number of working steps). In step 112, lapping mechanism setting is executed according to the input data. More specifically, the lapping mechanism setting includes plate rotational speed updating, slurry drop amount updating, swing motion execution/stop, and wiper operation/stop. The object to be set and controlled herein is a lapping mechanism 113. The lapping mechanism 113 includes a rotational drive mechanism for the lap plate 14, a swing drive mechanism for the arm 22, a supply mechanism for dropping a slurry onto the lapping surface 14A, and a wiper for removing an excess slurry from the lapping surface 14A.

Figure 19:
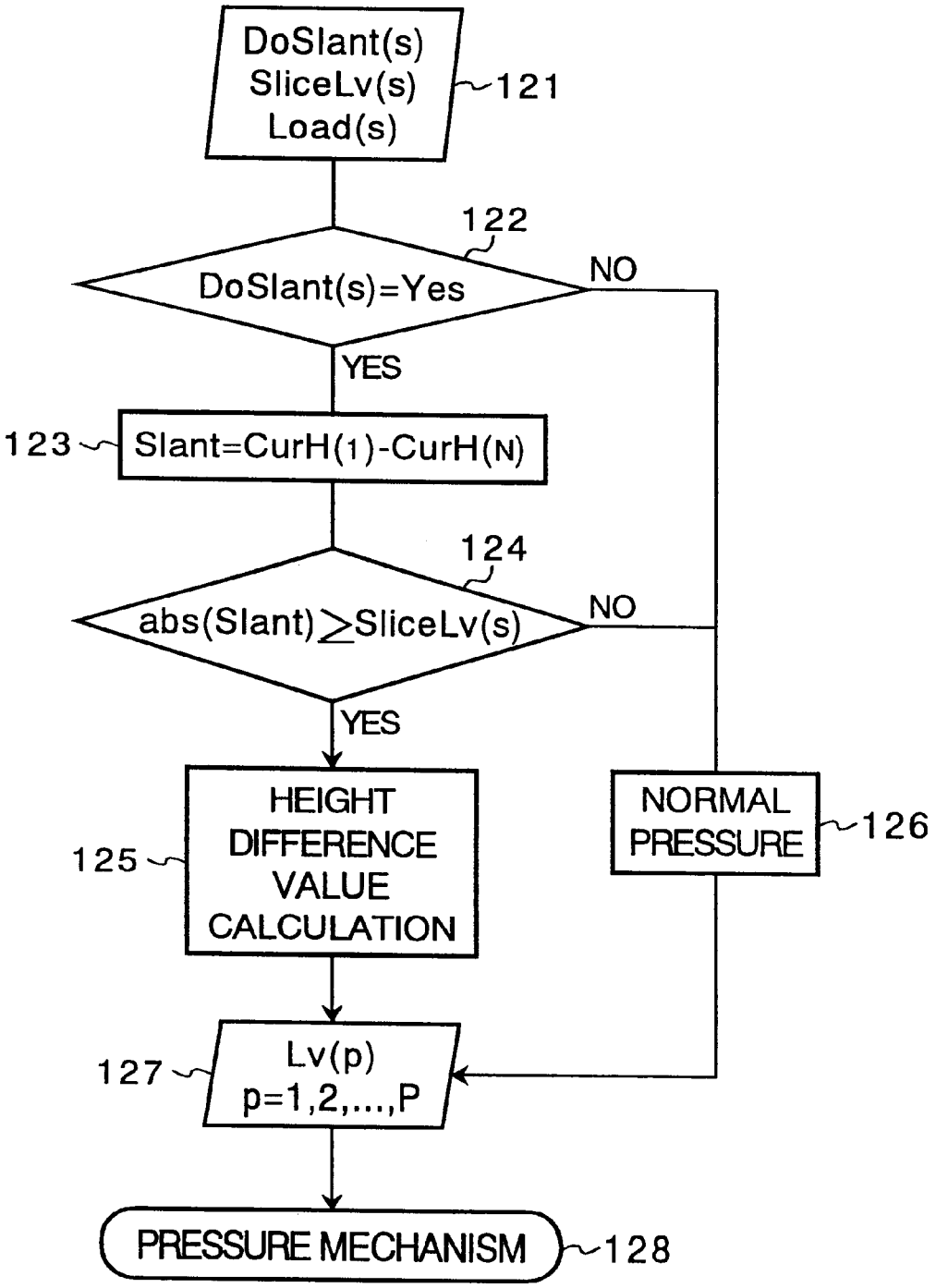
FIG. 19 is a flowchart showing a subroutine in a pressure mechanism section of the control system.

FIG. 19 is a flowchart showing the subroutine in the pressure mechanism section 85. As shown by reference numeral 121, the data to be input from the second data table 83B of the data managing section 83 to the pressure mechanism section 85 includes a height difference correction execution decision value (Yes, No) "DoSlant(s)" in the stepping "s", slice level or threshold "SliceLv(s)" in the stepping "s", and pressure value "Load(s)" in the stepping "s". In step 122, it is determined whether or not height difference correction is to be executed according to "DoSlant(s)". If the height difference correction is to be executed, the program proceeds to step 123. In step 123, a present height difference "Slant" is calculated according to the difference "CurH(1)−CurH(N)" between the present height CurH(1) of the ELG element 12*a* at the left end and the present height CurH(N) of the ELG element 12*a* at the right end. In step 124, it is determined whether or not the absolute value "abs(Slant)" of the present height difference "Slant" is greater than or equal to the threshold "SliceLv(s)". If "abs(Slant)" is greater than or equal to "SliceLv(s)", the program proceeds to step 125, whereas "abs(Slant)" is less than "SliceLv(s)", the program proceeds to step 126. Also in the case that it is determined that the height difference correction is not to be executed in step 122, the program proceeds to step 126. In step 125, a height difference correction value is calculated. In step 126, a balanced normal pressure value is calculated. As a result, a pressure instruction value Lv(p) in a pressure mechanism "p" (p=1, 2, . . . , P) is obtained as shown by reference numeral 127, in which P is the total number of pressure cylinders. The pressure instruction value obtained above is supplied to a pressure mechanism 128.

For example, in the lapping machine shown in FIG. 6, the pressure mechanism 128 includes the pressure cylinder 56 and the pair of balance cylinders 58 and 60. In this case, P=3, and "Lv(1)", "Lv(2)", and "Lv(3)" are supplied to the balance cylinder 58, the pressure cylinder 56, and the balance cylinder 60, respectively.

Figure 20:
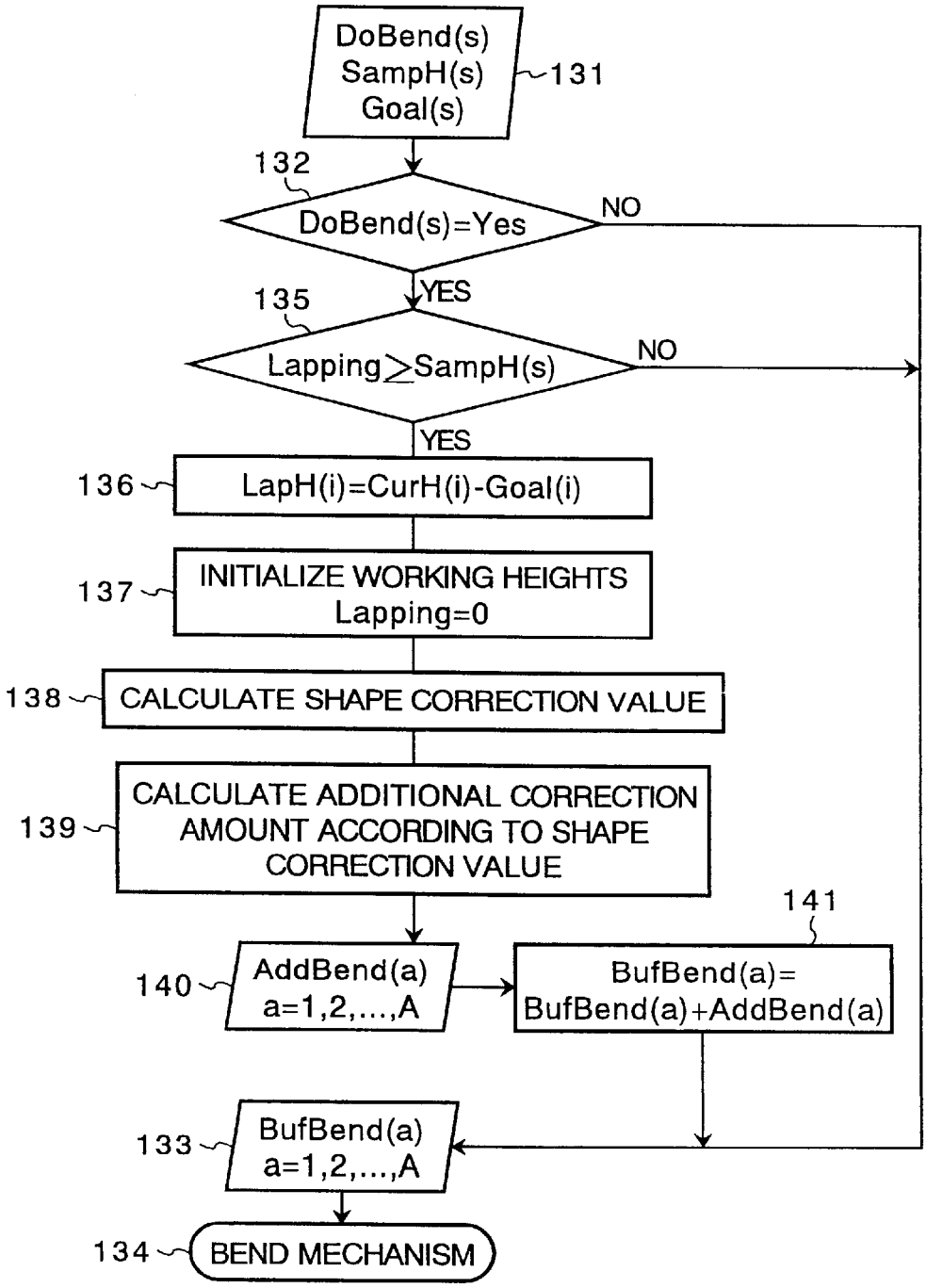
FIG. 20 is a flowchart showing a subroutine in a bend mechanism section of the control system.

FIG. 20 is a flowchart showing the subroutine in the bend mechanism section 86. As shown by reference numeral 131, the data to be supplied from the second data table 83B of the data managing section 83 to the bend mechanism section 86 includes a shape correction execution decision value (Yes, No) "DoBend(s)" in the stepping "s", sampling height "SampH(s)" as a threshold of a working process amount in the stepping "s", and target shape "Goal(s)" in the stepping "s". The target shape is defined as a set of target heights of the ELG elements.

In step 132, it is determined whether or not the shape correction is to be executed according to "DoBend(s)". If the shape correction is not to be executed, a present correction amount "BufBend(a)" (a=1, 2, . . . , A) is maintained as shown by reference numeral 133, in which A is the number of actuators in the bend mechanism. In this preferred embodiment, four short links 36 and three long links 38 are used, so that A=7. Accordingly, a bend mechanism 134 to which "BufBend(a)" is supplied includes the links 36 and 38 and the air cylinder 40.

If the shape correction (bend) is to be executed in step 132, the program proceeds to step 135, in which it is determined whether or not a present worked height "Lapping" is greater than or equal to the threshold "SampH(s)". The present worked height "Lapping" is a working process amount at present, and it is defined as an average value of decreases in height of the ELG elements. If "Lapping" is less than "SampH(s)", the program proceeds to step 133, in which "BufBend(s)" is maintained, whereas if "Lapping" is greater than or equal to "SampH(s)", the program proceeds to step 136, in which a lapping height "LapH(i)" defined as the amount to be worked is calculated by subtracting "Goal (i)" from "CurH(i)".

In step 137, the worked height is initialized by resetting "Lapping" to 0. In step 138, a shape correction value is calculated according to "LapH(i)" calculated in step 136. In step 139, an additional correction amount is calculated according to the shape correction value calculated in step 138. As shown by reference numeral 140, the additional correction amount is output as "AddBend(a)" (a=1, 2, . . . , A). In step 141, the present correction amount is updated by the calculation of "BufBend(a)=BufBend(a)+AddBend(a)". The updated correction amount (corresponding to a push/pull amount of each actuator of the bend mechanism) is supplied to the bend mechanism 134 as shown by reference numeral 133. The updated correction amount or the maintained correction amount is supplied also to the first data table 83A of the data managing section 83.

In the working control according to the present invention as mentioned above, the push/pull amount of each actuator of the bend mechanism is updated according to the working process amount on the workpiece. This will now be described from another aspect.

Figure 21A:
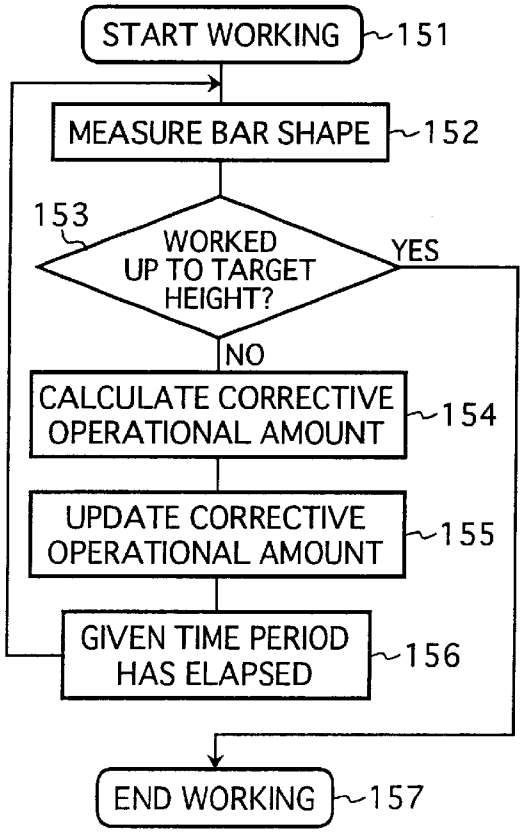
FIG. 21A PRIOR ART
FIGS. 21A and 21B are flowcharts for comparing the working control according to the present invention and the prior art.
Figure 21B:
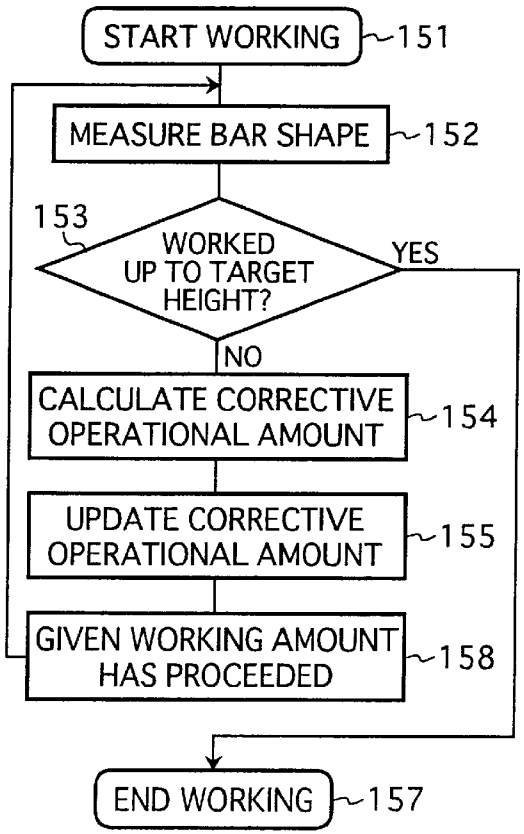

FIG. 21B is a flowchart for comparing the working control according to the present invention with the prior art shown in FIG. 21A. In the prior art working control shown in FIG. 21A, when the working is started in step 151, the shape of the row bar 11 is measured in step 152, and it is then determined whether or not the row bar 11 has been worked up to a target height in step 153. If the row bar 11 has been worked up to the target height, the program proceeds to step 157 to end the working, whereas if the row bar 11 has not been worked up to the target height, the program proceeds to step 154, in which a corrective operational amount is calculated. In step 155, the corrective operational amount is updated. When a predetermined time period has elapsed in step 156, the program returns to step 152.

In the above conventional working control, at the time the predetermined time period has elapsed after updating the corrective operational amount, the corrective operational amount is calculated again and then updated. Such control is intended to ensure a time period until the working by the use of the updated corrective operational amount becomes stable. However, the above time period for stabilization of the working is largely dependent on the corrective operational amount itself at this time, and is also largely affected by external factors such as the condition of the lap plate. As a result, stable control may be difficult in the conventional working control.

To the contrary, in the working control according to the present invention as shown in FIG. 21B, at the time the working has proceeded by a predetermined amount in step 158 after updating the corrective operational amount in step 155, the program returns to step 152. Thus, the present invention adopts the control flow that when a predetermined working amount has reached according to an actual polished amount, i.e., a working process amount (e.g., an average value of decreases in height from the time of updating the operational amount to the present time), the next operational amount is calculated again and updated, thereby allowing always stable working.

Figure 22:
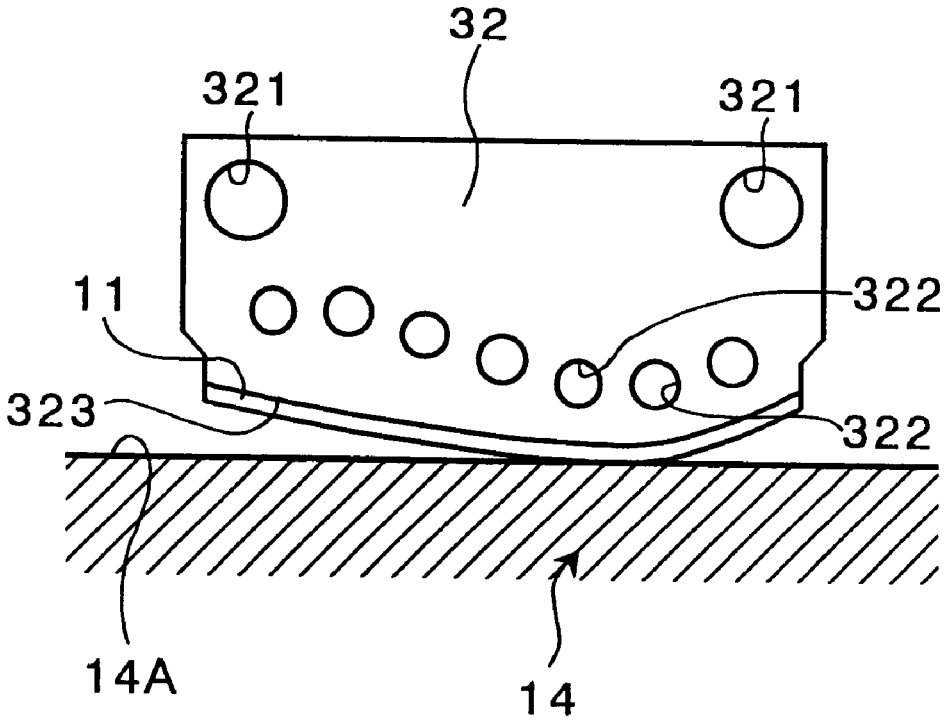
FIG. 22 is an elevational view showing the contact of a row bar in its deflected condition with a lapping surface.

If the calculated corrective operational amount is used without changes as an instruction value in step 155 for updating the corrective operational amount, there may occur a rapid change in the operational amount to cause a problem that the row bar 11 in its deflected condition may come into contact with the lapping surface 14A as shown in FIG. 22. In this condition, uniform working cannot be achieved, and there is also a possibility that the lap plate 14 may be deformed or the row bar 11 may be separated from the work surface 323. This problem described with reference to FIG. 22 can be eliminated by changing the operational amount (push/pull amount) by a predetermined unit amount. This predetermined unit amount corresponds to "AddBend(a)" mentioned with reference to FIG. 20, for example. The calculation of the operational amount in the bend mechanism may be made in accordance with Japanese Patent Application filed Mar. 19, 1999 by the present applicant (Title of the Invention: Polishing Apparatus, Polishing Method, and Manufacturing Method for Magnetic Head; Reference No.: 9805209), for example.

If the value of the predetermined unit amount is set too small, much time is required to reach the operational amount required, causing an increase in working time. Accordingly, by changing the predetermined unit amount according to the magnitude of the calculated operational amount, the working time can be reduced. Thus, the working time can be reduced by deciding the unit amount according to the difference between an updated value and an unupdated value of the operational amount in the bend mechanism.

Figure 23A:
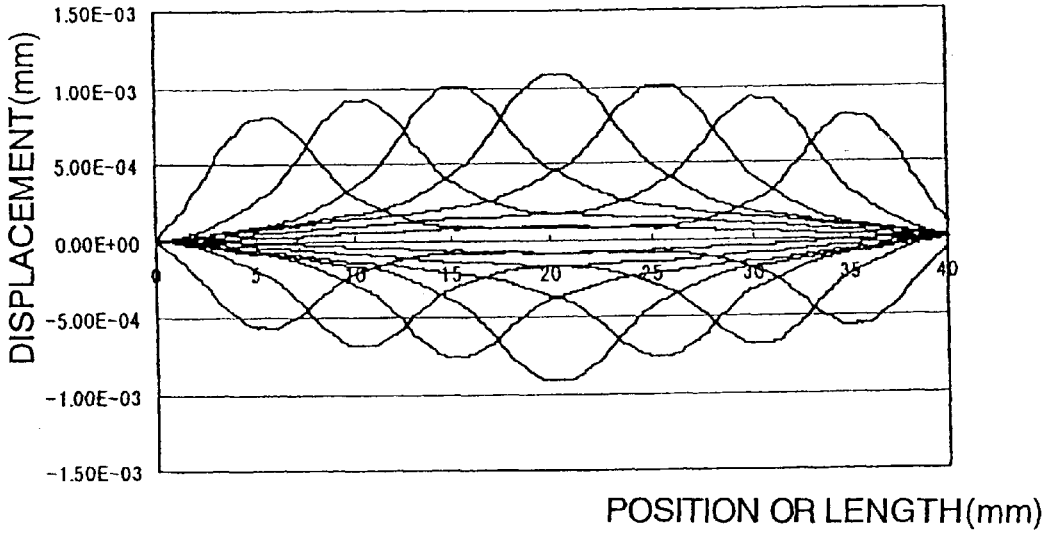
FIGS. 23A and 23B are graphs showing degrees of deformation by the operation of a row tool.
Figure 23B:
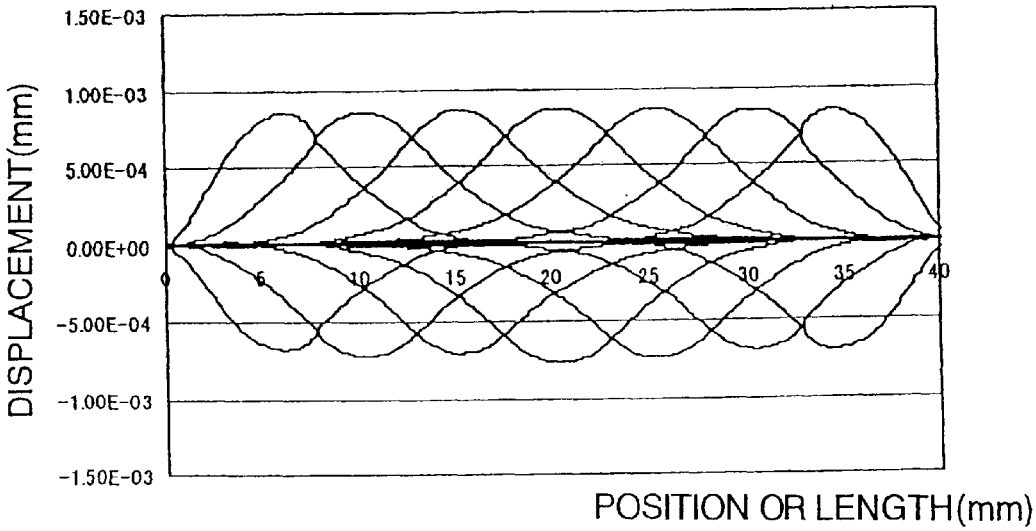

FIG. 23A is a graph showing the relation between displacement of the work surface 323 and position on the work surface 323 in the case that the same unit load is applied to each operation point (each hole 322) of the row tool 32. As apparent from this graph, the displacement is different according to the position of each operation point from the viewpoint of the structure of the row tool 32 having the plural operation points although the same unit load is applied to each operation point. Accordingly, by making the predetermined unit amount different at each operation point according to the displacement to the load at each operation point, uniform displacement can be obtained as shown in FIG. 23B. Thus, FIG. 23B shows an example that the displacement of the work surface is uniformed by applying different unit loads to the operation points.

Figure 24:
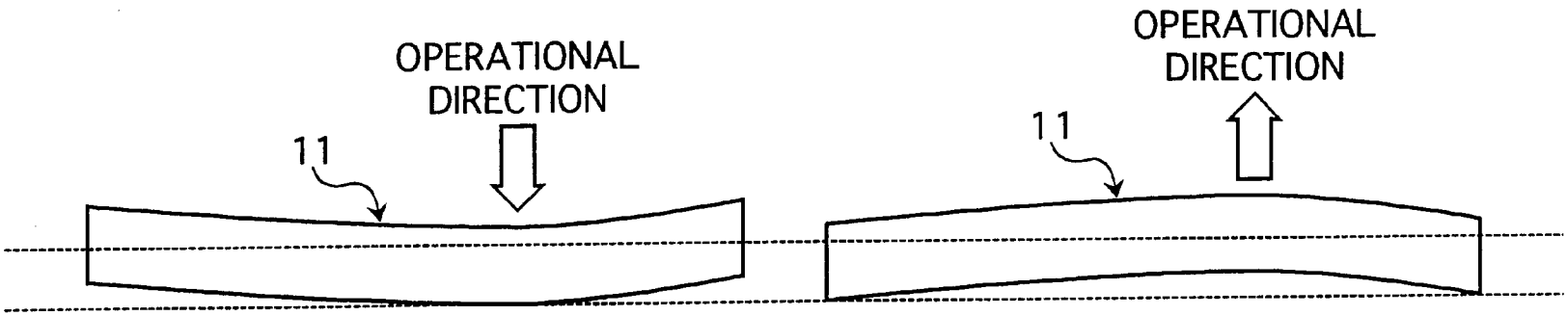
FIG. 24 is a schematic view showing a difference in working amount according to an operational direction.

The operation for shape correction of the row bar 11 includes a push operation of increasing the load to the row bar 11 on the lapping surface 14A and a pull operation of decreasing this load with respect to the operational amount at present. In the push operation, the working amount in unit time increases, whereas in the pull operation, the working amount in unit time decreases. For example, as apparent from FIG. 24, in polishing a fixed height, the polished amount in the push operation is different from that in the pull operation. In the method according to the present invention, the corrective operational amount is updated according to the working process amount, specifically, the polished height. Accordingly, the difference in polished amount due to the difference in operational direction may cause a hindrance to stable working. This hindrance can be eliminated by weighting with a coefficient according to the difference in operational direction, thereby allowing stable working independent of the operational direction (i.e., the push operation or the pull operation). For example, the predetermined unit amount mentioned above is weighted according to the direction of loading at each operation point. More specifically, the weighting coefficient in the pull operation is set larger than that in the push operation, thereby allowing stable working independent of the operational direction.

Figure 25:
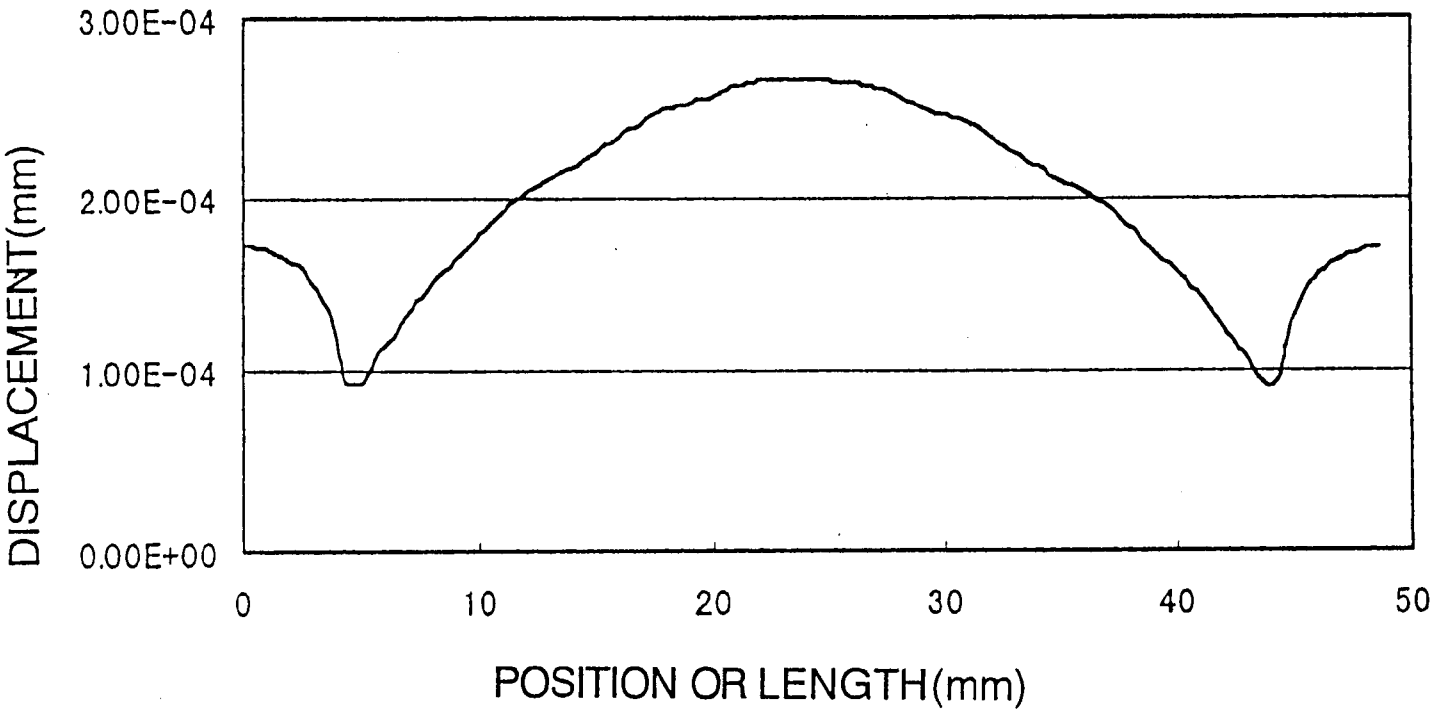
FIG. 25 is a graph showing an analytical result of displacement of a contact surface of a lap plate by a finite element method in the case of making the row bar and the row tool into pressure contact with the lap plate.

As mentioned above, in performing the working control of the row bar 11, not only the operational force by the bend mechanism section (see FIG. 14) is applied to the row bar 11 near each operation point, but also the pressure by the pressure mechanism section 85 is applied to the whole of the row bar 11. As a result, warpage occurs in the row bar 11 because of the structural effect of the row tool 32 as shown in FIG. 25. FIG. 25 is a graph showing an analytical result of displacement of a contact surface of the lap plate by a finite element method in the case of making the row bar and the row tool into pressure contact with the lap plate. It is known that the magnitude of this warpage changes according to the strength of the pressure operation. Accordingly, by adding the amount of this warpage to the final target shape, the structural effect of the row tool 32 can be eliminated. Thus, higher-precision working can be achieved by setting a target shape fit to the pressure applied by the pressure mechanism section 85.

Figure 26:
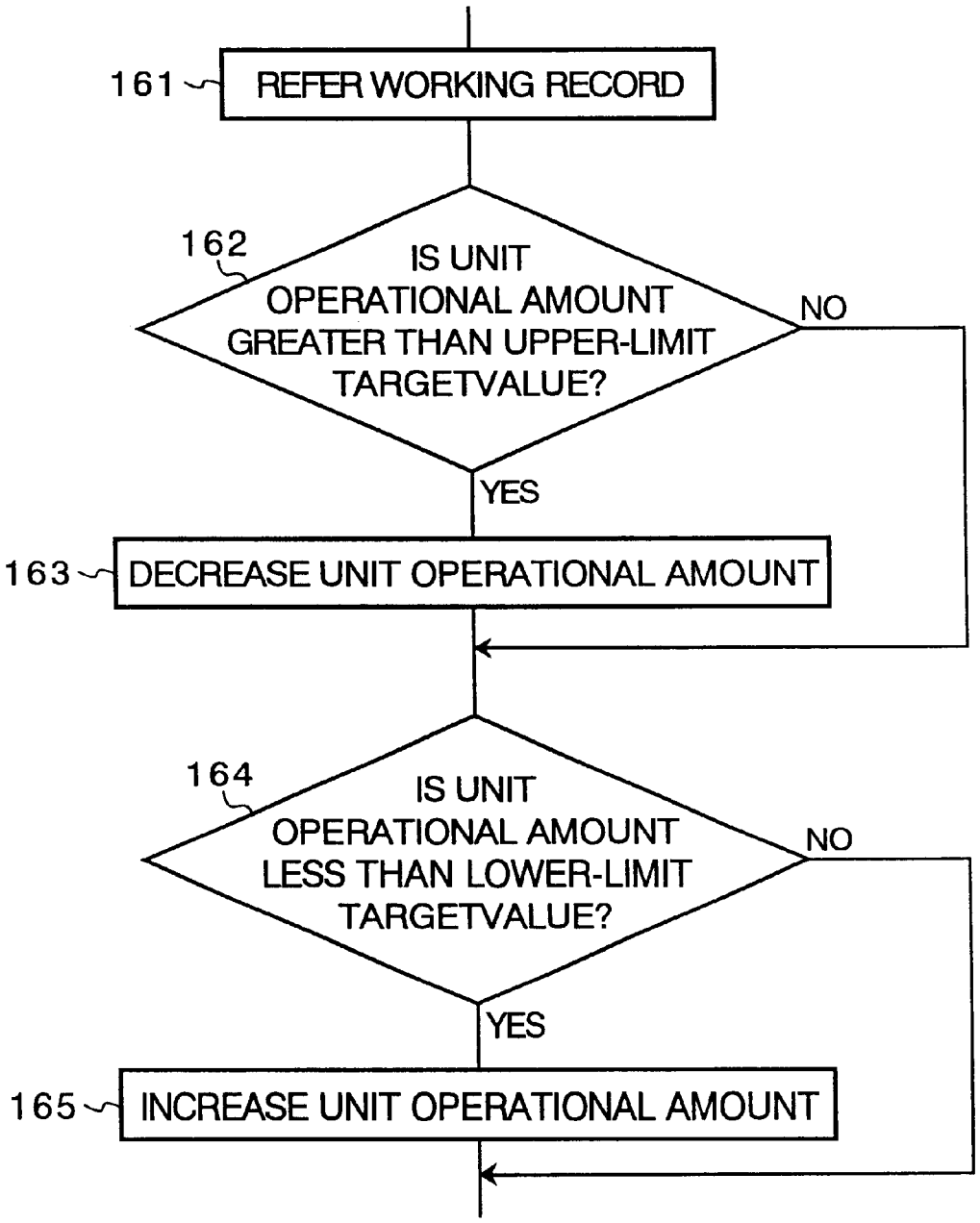
FIG. 26 is a flowchart showing an example of automatic adjustment of a unit operational amount.

FIG. 26 is a flowchart showing an example of automatic adjustment of a unit operational amount (corresponding to the "predetermined unit amount" mentioned above). In row tools as the lapping jigs, there is a minute difference in deformation characteristics between the row tools, and they may be deteriorated by repeated use. To cope with this problem, a parameter such as a unit operational amount is not fixed, but it is suitably changed. That is, changes in working information, e.g., working speed from the start of working to the present time, is always recorded. Then, the parameter is compared with a predetermined upper-limit target value and a predetermined lower-limit target value, and the parameter is then increased or decreased according to the result of comparison, thereby allowing higher-precision working.

This will now be described more specifically with reference to FIG. 26. In step 161, a working record is referred. The working record is read from the first data table 83A of the data managing section 83, for example. In step 162, it is determined whether or not the unit operational amount has become greater than the upper-limit target value. If the answer in step 162 is NO, the program proceeds directly to step 164, whereas if the answer in step 162 is YES, the unit operational amount is decreased in step 163, and the program then proceeds to step 164. In step 164, it is determined whether or not the unit operational amount has become less than the lower-limit target value. If the answer in step 164 is NO, the program is ended at once, whereas if the answer in step 164 is YES, the unit operational amount is increased in step 165, and the program is then ended. Thus, the unit amount is changed according to a working history to thereby achieve higher-precision working.

In this preferred embodiment of the present invention, simulation on the working may be performed. For example, after mounting the row bar fixed to the row tool to the working apparatus, the initial shape of the row bar is measured and thereafter the working simulation may be performed by a computer simultaneously with or earlier than actual working. The actual working and the simulation are performed in parallel, and information such as a working record and an estimated working amount is mutually transferred. By comparing the result of the actual working and the estimation by the parallel working simulation, the parameter required for the working control can be easily adjusted, and abnormality of the ELG elements and each mechanism section can also be easily detected. This will now be described more specifically.

Figure 27:
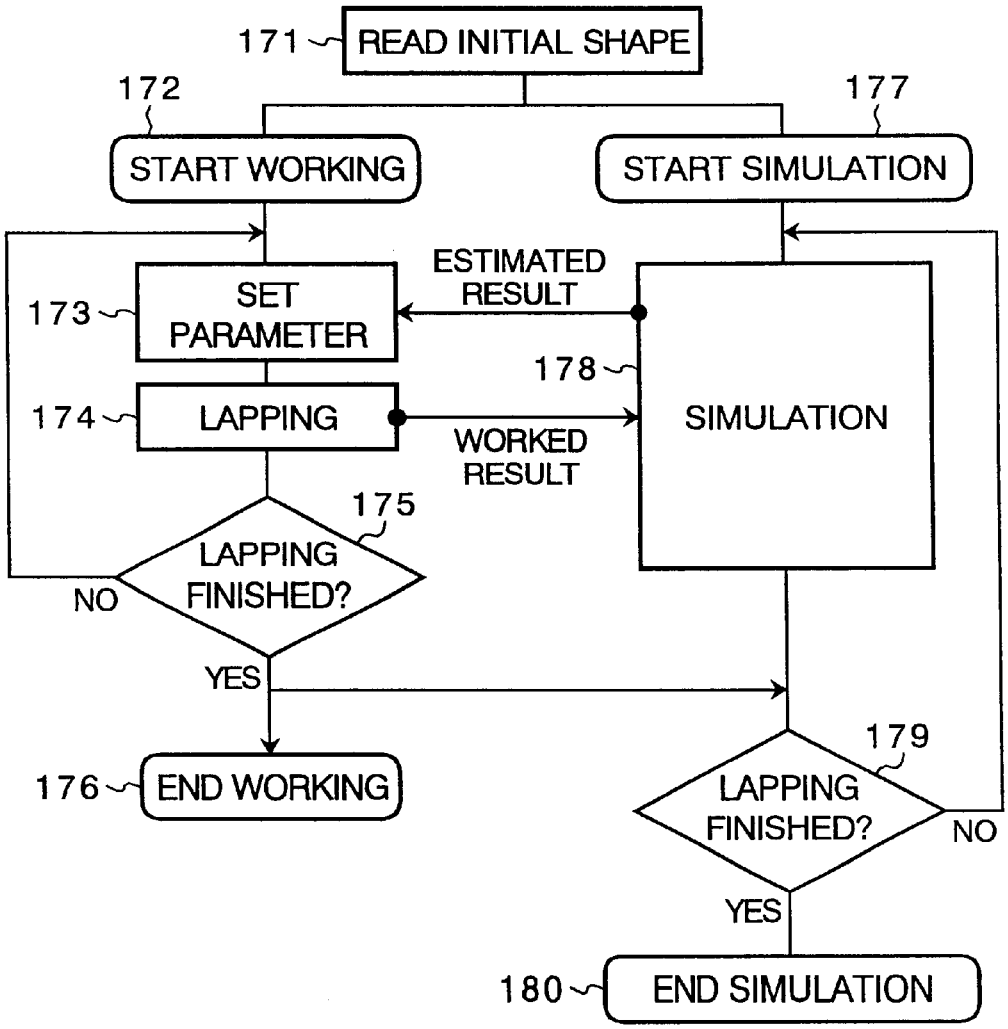
FIG. 27 is a flowchart showing an example of parallel working simulation.

FIG. 27 is a flowchart showing an example of the parallel working simulation. In step 171, the initial shape of the row bar is read. In step 172, the actual working is started according to the result of reading in step 171. When the actual working is started, the parameter inclusive of the predetermined unit amount mentioned above is set in step 173, and the lapping is executed in step 174. In step 175, it is determined whether or not the lapping has been finished. If the lapping has not been finished, the program returns to step 173, whereas if the lapping has been finished, the program proceeds to step 176 to end the working. On the other hand, the simulation is started in step 177 simultaneously with or earlier than the actual working, according to the initial shape read in step 171. In step 178, the content of the simulation is referred. For example, the parameter can be easily set in step 173 according to the estimated result included in the simulation. Alternatively, the worked result by the lapping in step 174 may be fed back to the simulation of step 178, thereby improving the accuracy of the result by the simulation. Then, the program proceeds to step 179, in which it is determined whether or not the lapping has been finished. If the lapping has not been finished, the program returns to step 178, whereas if the lapping has been finished, the program proceeds to step 180 to end the simulation.

The use of a sensor or the like to detect abnormality of a working apparatus to which the working control is applied, e.g., to detect the occurrence of a failure in any actuator of the bend mechanism section 86, is not better in consideration of the scale or the like of the actuator. In this preferred embodiment, by comparing the result of the working simulation and the working record (the working amount and the working speed) of the actual working, it can be detected whether or not the actuator or the like functions reliably. Further, in the working control the working to the row bar is performed according to the measurement by the plural ELG elements provided at different positions in the row bar. Accordingly, in the case that any one of the ELG elements becomes abnormal, a correct value cannot be measured, causing a hindrance to proper working control. In this preferred embodiment, the abnormality of any one of the ELG elements can be detected according to the result of the working simulation. This will now be described more specifically.

Figure 28:
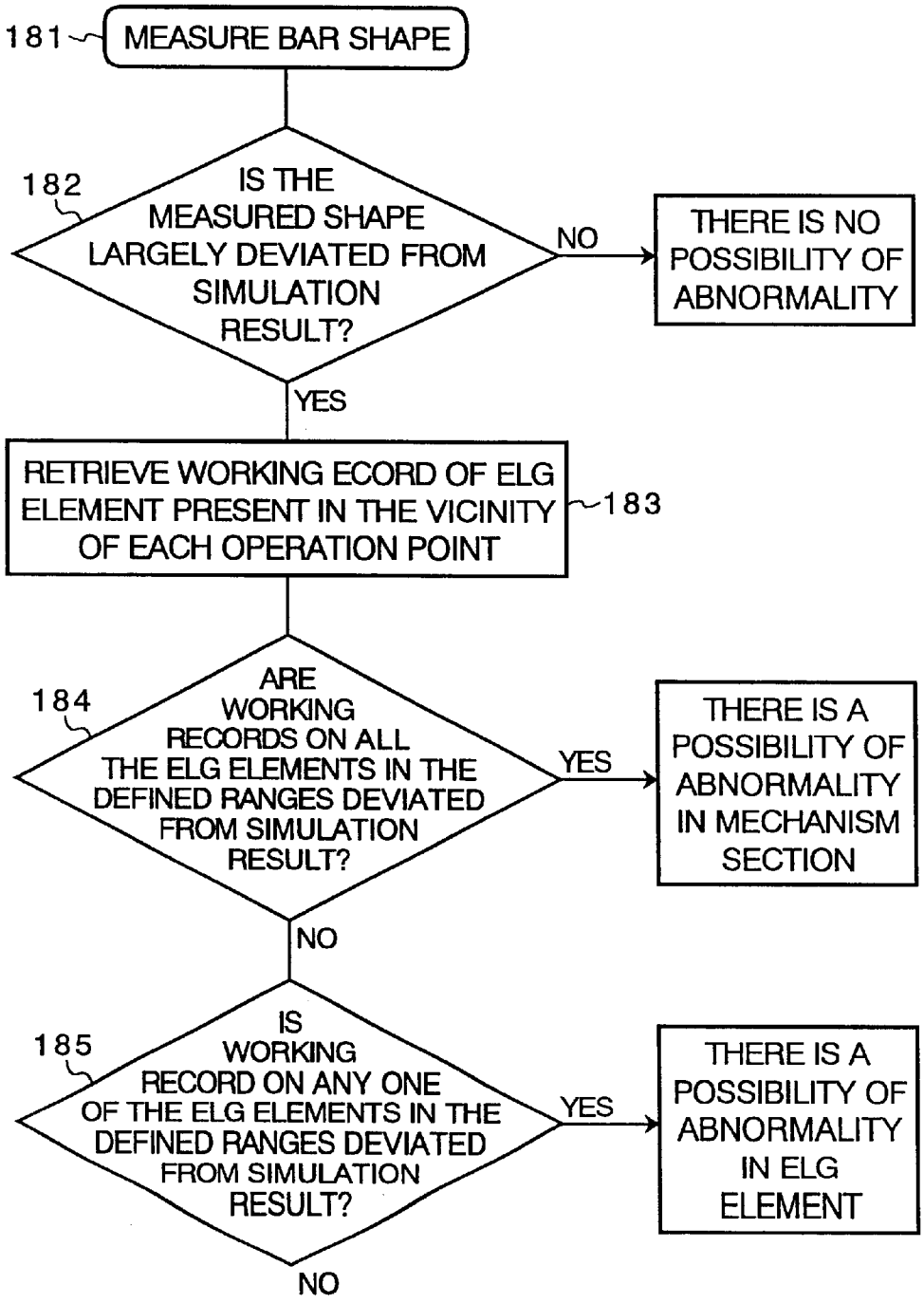
FIG. 28 is a flowchart showing an example of detection of abnormality.

FIG. 28 is a flowchart showing an example of detection of abnormality. In step 181, the shape of the row bar is measured. In step 182, it is determined whether or not the measured shape of the row bar is largely deviated from the result of the simulation. If the answer in step 182 is NO, it is determined that there is no possibility of abnormality. If the answer in step 182 is YES, the program proceeds to step 183, in which the working record of the ELG element present in the vicinity of each operation point is retrieved. For example, in the case that a certain one of the holes 322 in the row tool 32 shown in FIG. 7 is the operation point, the range between two holes 322 adjacent to the certain hole 322 corresponds to the vicinity of the certain hole 322, and the working record of the ELG element present in the vicinity of the certain hole 322 is retrieved.

In step 184, it is determined whether or not the working records on all the ELG elements in the above-defined ranges are deviated from the result of the simulation. If the answer in step 184 is YES, it is determined that there is a possibility of abnormality in any one of the mechanism sections including the bend mechanism section 86, whereas if the answer in step 184 is NO, the program proceeds to step 185, in which it is determined whether or not the working record on any one of the ELG elements in the above-defined ranges is deviated from the result of the simulation. If the answer in step 185 is YES, it is determined that there is a possibility of abnormality in this ELG element.

Figure 29:
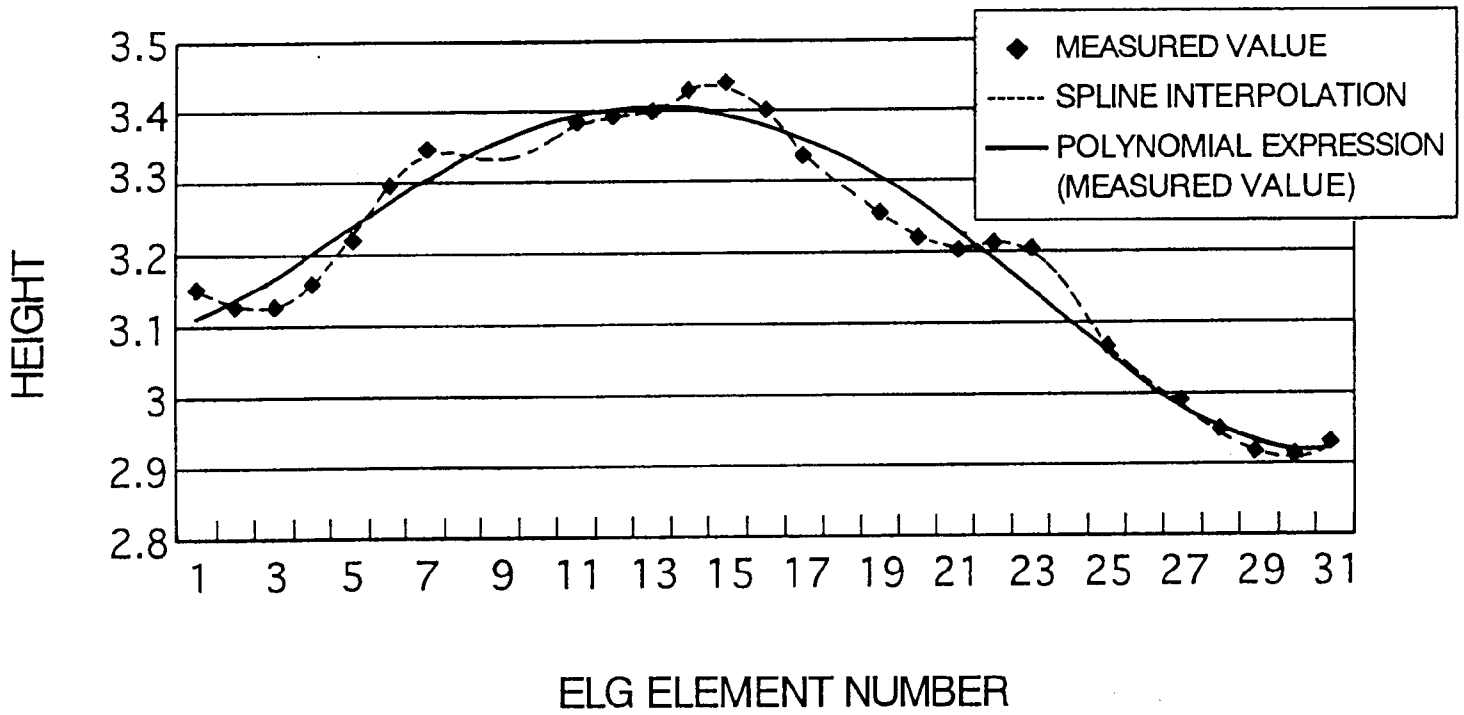
FIG. 29 is a graph showing a difference between fourth-order polynomial approximation interpolation and spline interpolation.

As a method of expressing the shape of a workpiece after elimination of sensor abnormality or the like, a higher-order polynomial approximation curve is conventionally known (e.g., Japanese Patent Laid-open Nos. 10-146758 and 11-134614). For example, in the case that the measured values of a plurality of heights are obtained by a plurality of ELG elements as shown in FIG. 29, interpolation between the measured values can be made as shown by the solid line by using a fourth-order polynomial approximation curve. In FIG. 29, the vertical axis represents the height (in arbitrary unit), and the horizontal axis represents the numbers of the ELG elements arranged along the workpiece. The height corresponds to "CurH(i)" mentioned above with reference to FIG. 17, for example.

To realize higher-precision working, the bend to the actually measured shape is preferable over the shape interpolated by the approximate expression. However, there is a case that a sensor for measuring the shape of the workpiece is abnormal, and there is also a possibility that a slider flying surface of a magnetic head may be excessively curved in the case that the actual row bar has a largely uneven shape. In this preferred embodiment, bend limitation and removal of abnormal values/interpolation are performed to obtain the shape of the workpiece nearer to the actual shape.

Figure 30:
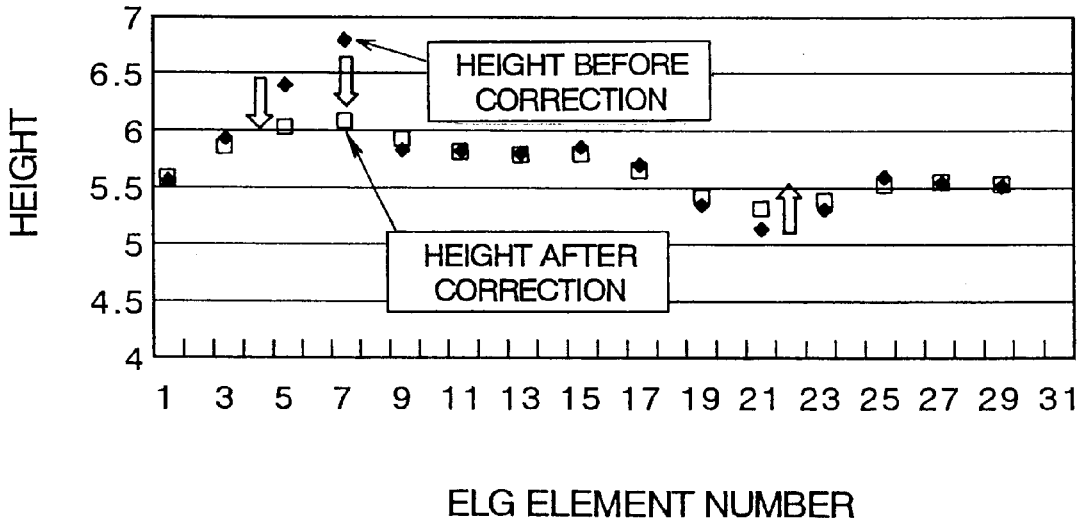
FIG. 30 is a graph for illustrating bend limitation.

In the case that the workpiece has a largely uneven shape, the corrected shape of the workpiece becomes also largely uneven. If the workpiece having a largely uneven shape continues to be worked, the uneven corrected shape is transferred to the row bar (the workpiece), and there is a possibility that the slider flying surface of each magnetic head cut from the row bar may be curved. To eliminate this possibility, the measured shape of the workpiece is not used as it is, but limitation is given to the unevenness of the shape to regard the largely uneven shape as a gently uneven shape, thereby ensuring a properly corrected shape of the workpiece as a whole although the working accuracy at a largely tip portion of the workpiece is sacrificed. For example, by correcting the height under suitable conditions as shown in FIG. 30, the largely uneven shape can be regarded as a gently uneven shape (to be hereinafter described in detail). In FIG. 30, the vertical axis represents the height (in arbitrary unit), and the horizontal axis represents the numbers of the ELG elements.

In this preferred embodiment, the measurement of the workpiece shape uses a method of converting the resistances of the plural ELG elements arranged along the workpiece into the heights. Accordingly, in the case that any one of the ELG elements is abnormal, there is a possibility that the workpiece shape may not be correctly measured. For example, if one of the ELG elements is abnormal to continue the shape correction, the measured value of this abnormal ELG element has an adverse effect on the other normal portion, causing a remarkable reduction in shape accuracy of the row bar as a whole. To cope with this problem, the shape of any abnormal portion can be estimated by detecting abnormality of the ELG elements and using normal values at the other normal portion to perform interpolation by a third-order spline curve (see FIG. 31).

Figure 31:
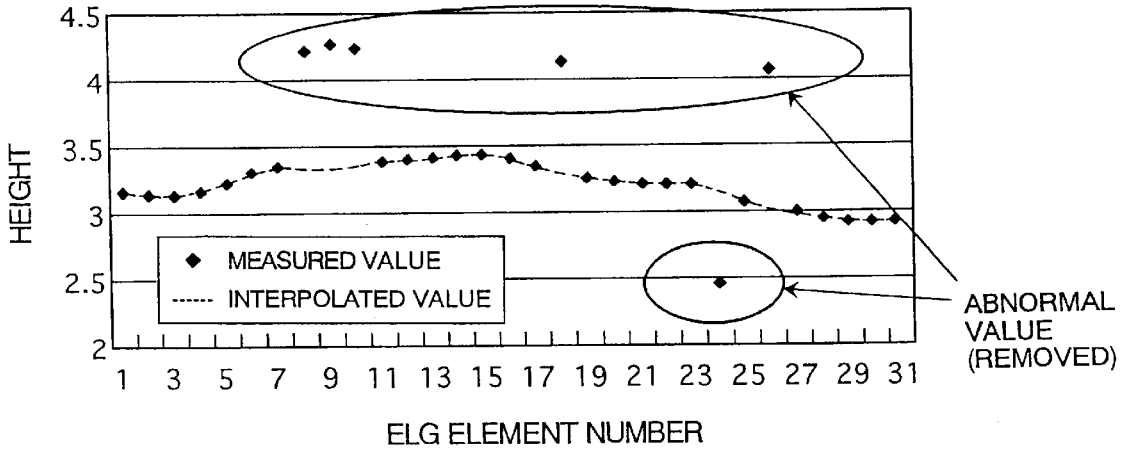
FIG. 31 is a graph for illustrating removal of abnormal values and spline interpolation.

In the example shown in FIG. 31, the measured values determined to be due to abnormality of the ELG elements are removed as abnormal values, and interpolated values are obtained by a third-order spline curve according to the other measured values not removed. In FIG. 31, the vertical axis represents the height (in arbitrary unit) and the horizontal axis represents the numbers of the ELG elements. By performing the interpolation using the third-order spline curve, arbitrary finite points on an x-y coordinate plane can be connected by a smooth curve. This method is characterized in that the interpolation is made by piecewise third-order expressions passing given n points (Xi, Yi) (i=0, 1, 2, . . . , (n−1); X0<X1<X2<. . . <X(n−1)). The joints of these third-order expressions are continuous by a second-order derivative at X1, X2, . . . , X(n−2).

Thus, the properly corrected shape of the workpiece as a whole can be ensured by detecting abnormality of the ELG elements as resistance elements and then correcting the push/pull amount of the bend mechanism according to the detected abnormality.

Figure 32:
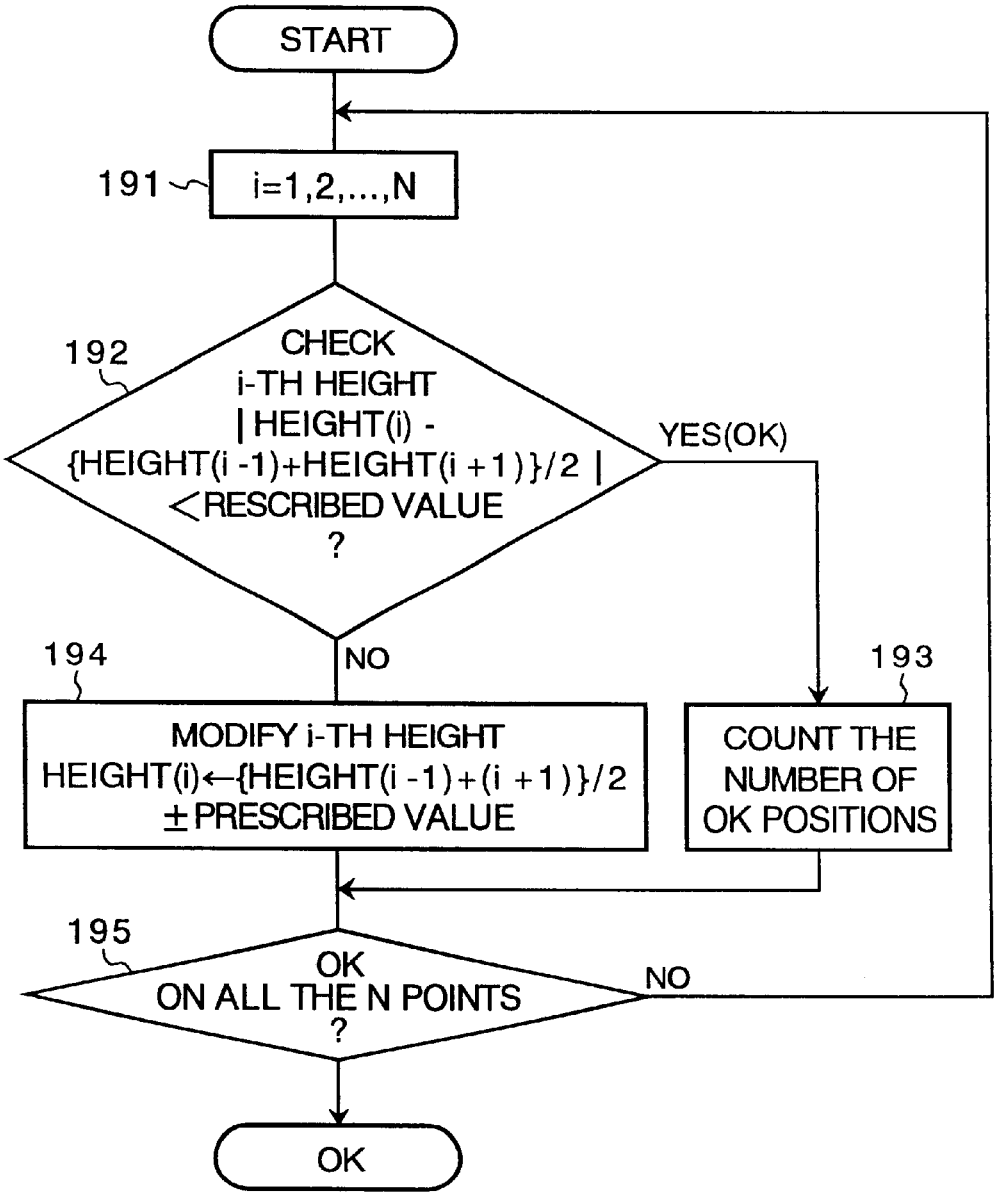
FIG. 32 is a flowchart showing a specific example of the bend limitation.

A specific example of the bend limitation described with reference to FIG. 30 will now be described. FIG. 32 is a flowchart showing a specific example of the bend limitation. In step 191, the integer i for designating the plural ELG elements arranged along the workpiece from one end thereof in sequence is defined. The integer i is sequentially incremented from 1 possibly up to the number N of the ELG elements.

In step 192, the height of the i-th ELG element, i.e., the height(i) is checked. More specifically, it is determined whether or not the following condition is satisfied.

$$|\text{height}(i)-\{\text{height}(i-1)+\text{height}(i+1)\}/2|<\text{prescribed value}$$

If this condition is satisfied, the program proceeds to step 193, in which the number of the ELG elements satisfying the condition is counted. If the condition is not satisfied, the program proceeds to step 194, in which the height(i) is modified. More specifically, the height(i) is replaced by {height(i−1)+height(i+1)}/2±(the prescribed value), in which when the value inside the absolute value symbol of the above condition is positive, + of ± is adopted, whereas when the value is negative, − of ± is adopted.

After execution of step 193 or step 194, the program proceeds to step 195, in which it is determined whether or not all the N ELG elements satisfy the condition. If the answer in step 195 is NO, the program returns to step 191, whereas if the answer in step 195 is YES, the program is ended. The reason for repetition of this program in the case that all the N ELG elements do not satisfy the condition is that there is a case that when some height is modified in step 194, the heights adjacent to this height may not newly satisfy the condition of step 192.

Thus, it is determined whether or not a specific condition is satisfied, and the push/pull amount of the bend mechanism is corrected according to this determination, thereby allowing the limitation of excess bend and accordingly preventing excess curvature of the slider flying surface of a magnetic head obtained.

The row tool functions to generate a displacement in the row bar to thereby correct the row bar. Therefore, finer correction of the row bar requires the generation of a finer displacement in the row bar. Increasing the number of the operation points may be proposed to obtain a finer displacement. However, there is a limit to increasing the number of the operation points in consideration of a dimensional limit to a drive mechanism for operation and a working limit to the row tool. In this respect, an object of the present invention is to provide a row tool (lapping jig) which can perform finer correction of the row bar. Some preferred embodiments intended to attain this object will now be described.

Figure 33:
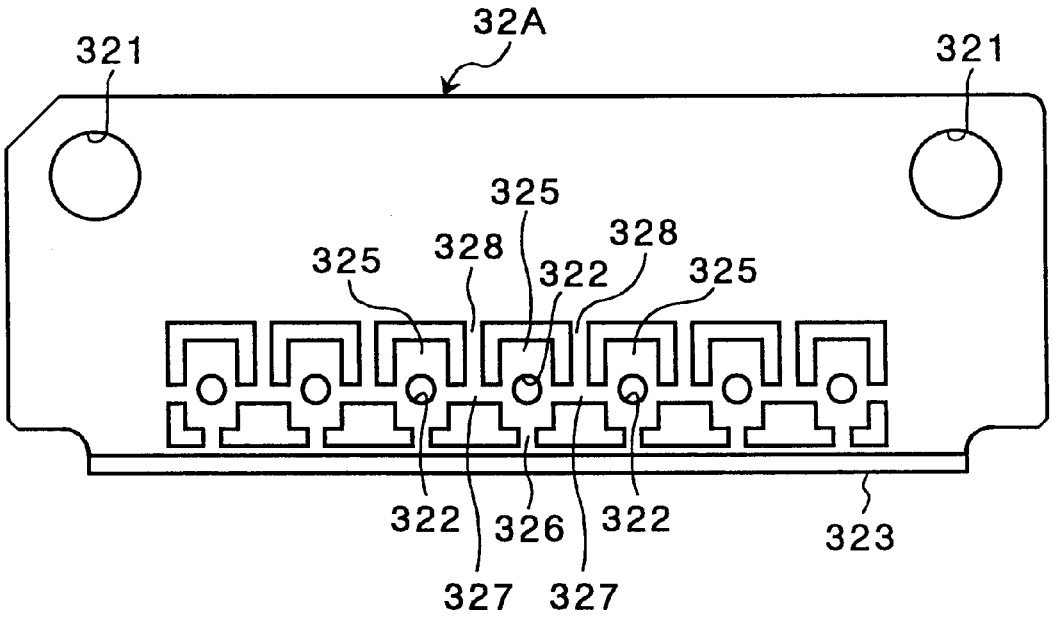
FIG. 33 is an elevational view of a row tool according to a second preferred embodiment of the present invention.

FIG. 33 is an elevational view showing a row tool 32A according to a second preferred embodiment of the present invention. Like the row tool 32 shown in FIG. 7, the row tool 32A has a pair of holes 321 formed to mount the row tool 32A to the adapter 26, a plurality of (e.g., seven in this preferred embodiment) holes 322 formed as the operation points, and a work surface 323 to which a row bar as a workpiece is bonded by means of a hot-melt wax, for example. The holes 322 are arranged at equal intervals along the work surface 323.

Particularly in this preferred embodiment, the row tool 32A is formed with a plurality of displacing portions 325 respectively corresponding to the holes 322. Each displacing portion 325 is supported to a lower portion on the work surface 323 side by a vertically extending columnar structure 326, and is connected to the opposite adjacent displacing portions 325 by horizontally extending columnar structures 327. Each columnar structure 327 is supported at its substantially central portion to an upper portion opposite to the work surface 323 by a vertically extending columnar structure 328.

Figure 34A:
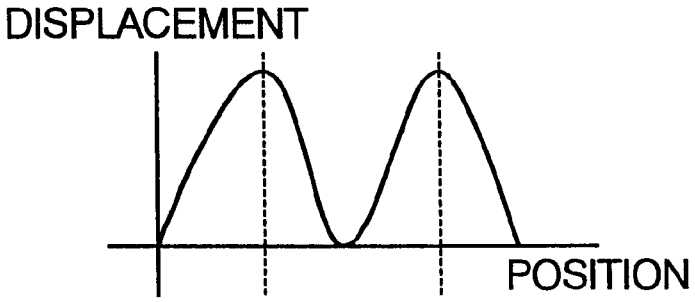
FIGS. 34A and 34B are graphs for comparing the row tool shown in FIG. 7 and the row tool shown in FIG. 33 about the relation between displacement and position on the work surface.
Figure 34B:
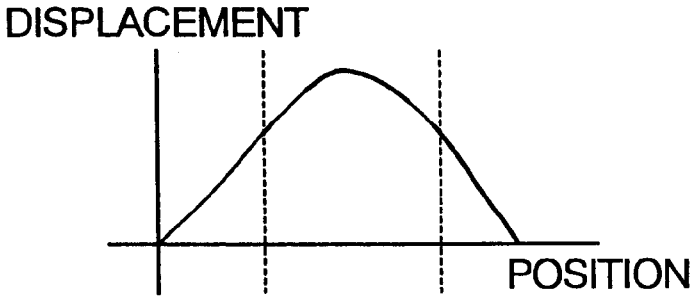

FIGS. 34A and 34B are graphs for comparing the row tool 32 shown in FIG. 7 and the row tool 32A shown in FIG. 33 about the relation between displacement and position on the work surface 323 in the case that load is applied to any two adjacent ones of the holes 322 at the same time in the upward direction. In each of FIGS. 34A and 34B, the broken lines show positions corresponding to the two adjacent holes 322.

In the row tool 32 shown in FIG. 7, fixed points are present, so that there is generated displacement having peaks at horizontal positions respectively coinciding with the horizontal positions of the centers of the adjacent holes 322 as shown in FIG. 34A. To the contrary, in the row tool 32A shown in FIG. 33, the above-mentioned specific structure is formed, so that there is generated displacement having a peak at a horizontal position coinciding with the horizontal position of a midpoint between the adjacent holes 322 as shown in FIG. 34B. Accordingly, by using the row tool 32A shown in FIG. 33, displacement can be generated also at any positions where the operation holes are absent according to the combination of the plural operation points, thereby effecting finer correction.

While each of the pair of holes 321 for mounting the row tool 32A to the adapter 26 is circular as shown, one of the pair of holes 321 may be elongated in the horizontal direction, for example. In this case, easiness of mounting of the row tool 32A can be improved as preventing rotation of the row tool 32A.

Figure 35:
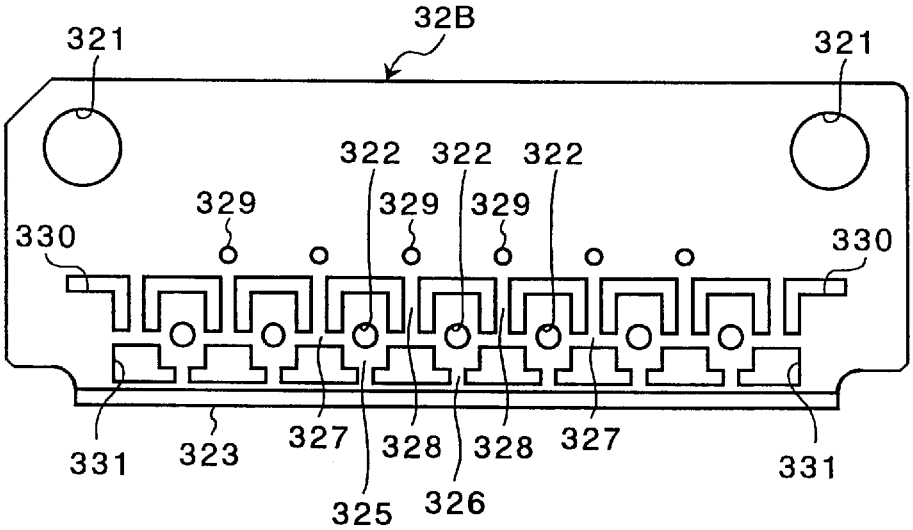
FIG. 35 is an elevational view of a row tool according to a third preferred embodiment of the present invention.

FIG. 35 is an elevational view of a row tool 32B according to a third preferred embodiment of the present invention. In contrast with the row tool 32A shown in FIG. 33, the row tool 32B is characterized in that a plurality of holes 329 are formed substantially in a line. Each hole 329 is positioned on the upper side of the columnar structure 328 formed between the adjacent holes 322. The formation of the holes 329 allows an increase in displacement of the work surface 323 by the pressure applied to the holes 322. The increase in displacement of the work surface 323 is adjustable according to the size of each hole 329, for example. Further, in the third preferred embodiment, additional holes 330 and 331 are formed outside of the right and left end holes 322, so as to increase the displacement of the work surface 323 by the pressure applied to the right and left end holes 322.

Figure 36:
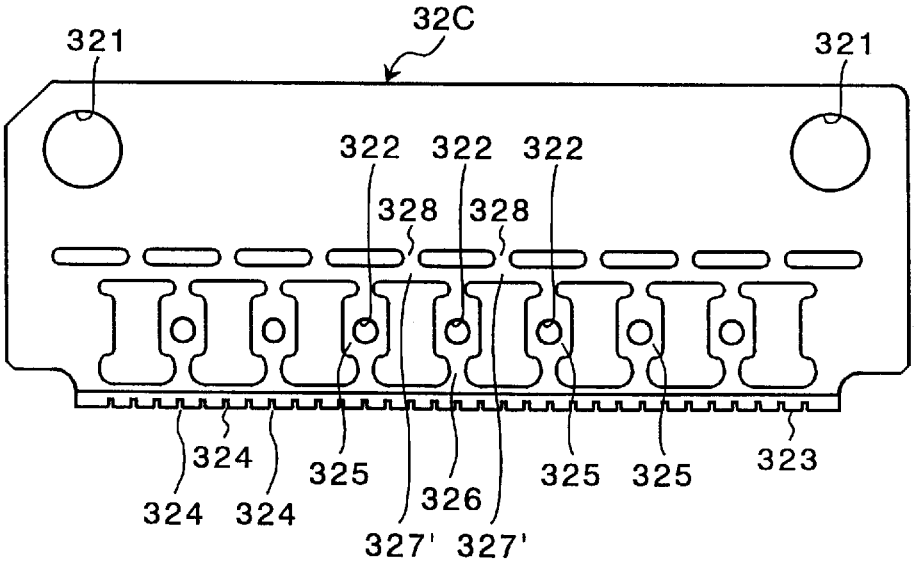
FIG. 36 is an elevational view of a row tool according to a fourth preferred embodiment of the present invention.

FIG. 36 is an elevational view of a row tool 32C according to a fourth preferred embodiment of the present invention. In contrast with the horizontal columnar structures 327 of the row tool 32A shown in FIG. 33, the row tool 32C is characterized in that columnar structures 327' are formed at higher positions. Also with this structure, it is possible to provide a row tool which can perform finer correction. Like the row tool 32 shown in FIG. 7, the work surface 323 is formed with a plurality of grooves 324 for use in dicing the row bar.

Figure 37:
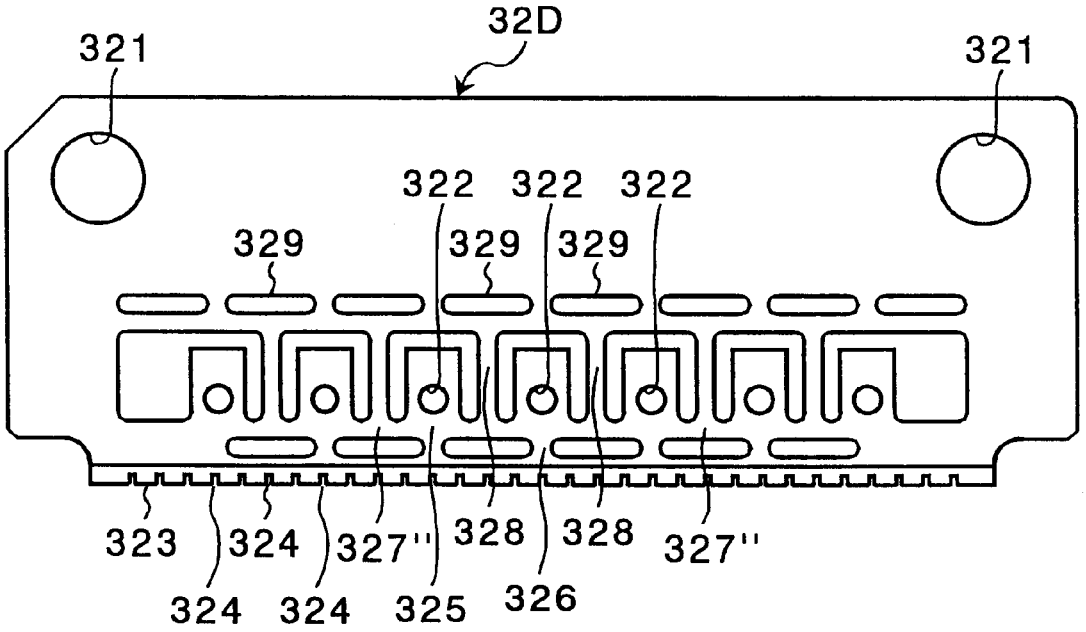
FIG. 37 is an elevational view of a row tool according to a fifth preferred embodiment of the present invention.

FIG. 37 is an elevational view of a row tool 32D according to a fifth preferred embodiment of the present invention. In contact with the horizontal columnar structures 327 of the row tool 32A shown in FIG. 33, the row tool 32D is characterized in that columnar structures 327" are formed at lower positions. Also with this structure, it is possible to provide a row tool which can perform finer correction.

According to the second to fifth preferred embodiments mentioned above, so complicated hole structures are not required, so that mass production of the row tool can be easily effected without the need for any costly machining techniques such as wire electrical discharge machining of a metallic material. Further, since the row tool can be produced by die cutting, not only a metallic material such as stainless steel, but also a ceramic material such as alumina is easily adoptable for the material of the row tool.

Figure 38:
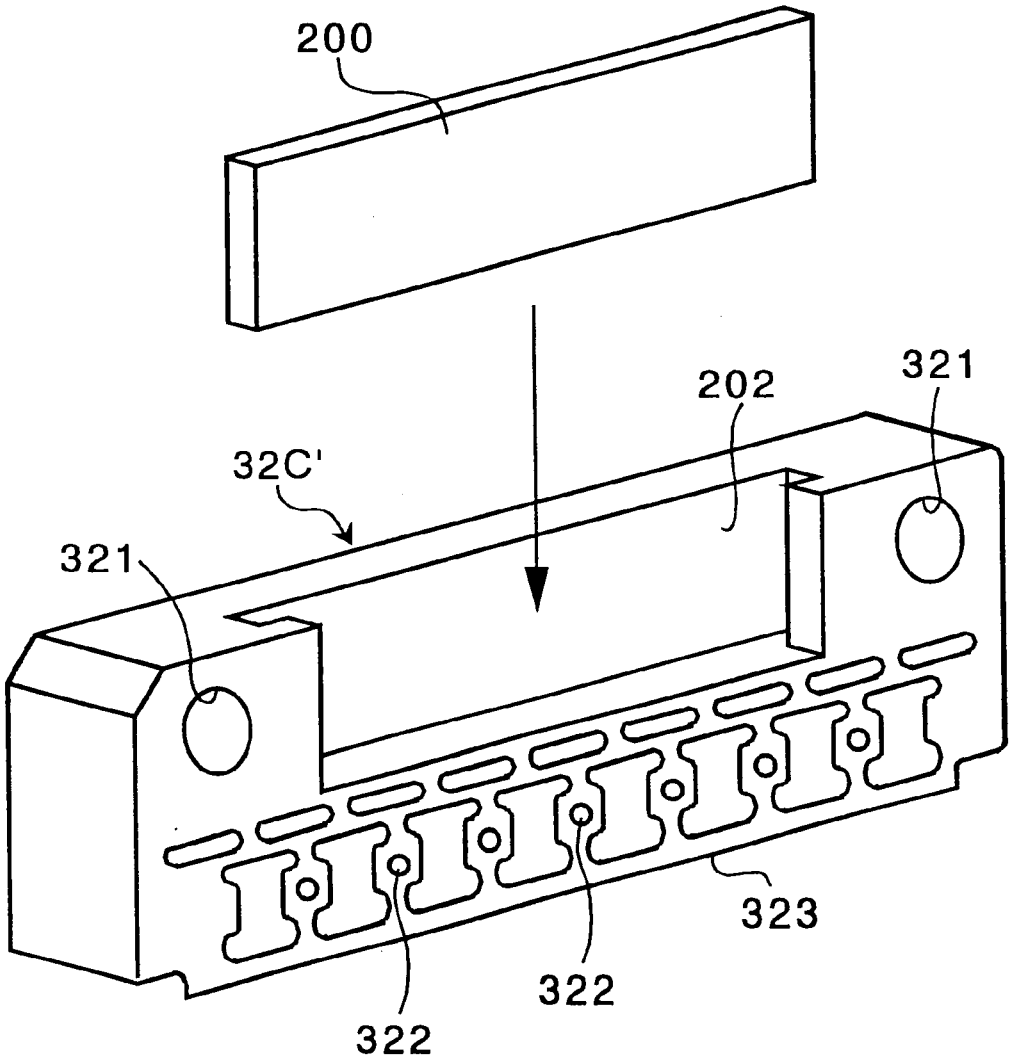
FIG. 38 is a perspective view of a row tool according to a sixth preferred embodiment of the present invention.

FIG. 38 is a perspective view of a row tool 32C' according to a sixth preferred embodiment of the present invention. In contrast with the row tool 32C shown in FIG. 36, the row tool 32C' is formed with a groove 202 for mounting a printed wiring board 200. The ELG elements of the row bar to be mounted on the work surface 323 of the row tool 32C' are very small, and it is therefore difficult to bring a probe into direct contact with each ELG element. Conventionally, a printed wiring board for making the contact of the probe with each ELG element is bonded to the surface of a row tool, and the resistance of each ELG element is measured through the printed wiring board. In this conventional method, however, the steps of bonding and separating the printed wiring board are required, causing a reduction in working efficiency. According to this preferred embodiment, the groove 202 for mounting the printed wiring board 200 is formed in the row tool 32C', thereby eliminating the need for the steps of bonding and separating the printed wiring board to improve the working efficiency.

According to the present invention as described above, it is possible to provide a method and apparatus for polishing and lapping jig which can perform stable working control or high-precision working control. The effects obtained by the specific preferred embodiments of the present invention have been described above, so the description thereof will be omitted herein.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A method of polishing a workpiece having a plurality of resistance elements by operating a plurality of bend mechanisms to push/pull said workpiece with respect to a polishing surface, comprising the steps of:

measuring a shape of said workpiece;

calculating an operational amount of each of said bend mechanisms according to said shape measured;

pressing said workpiece on said polishing surface with said bend mechanisms according to said operational amount calculated; and updating said operational amount according to a working amount of said workpiece.

2. A method according to claim 1, wherein said calculated operational amount is reached by changing said operational amount by a predetermined unit amount.

3. A method according to claim 2, wherein said unit amount is decided according to a difference between an updated value of said operational amount and an unupdated value of said operational amount.

4. A method according to claim 2, wherein said unit amount is set for each of said bend mechanisms.

5. A method according to claim 2, wherein said unit amount is set according to an update amount of said operational amount.

6. A method according to claim 2, wherein said working amount as a reference of updating said unit amount or said operational amount is set according to a working history.

7. A method according to claim 1, further comprising the step of performing simulation on the working to said workpiece.

8. A method according to claim 7, further comprising the step of detecting abnormality of a working apparatus including said bend mechanisms according to the result of said simulation.

9. A method according to claim 1, wherein said operational amount is calculated according to the measured height of each of said resistance elements.

10. A method according to claim 9, wherein a difference between the height of a certain one of said resistance elements and the average of the heights of the two resistance elements adjacent to said certain resistance element is calculated.

11. A method according to claim 10, wherein when said difference is greater than a predetermined value, the height of said certain resistance element is replaced by a value calculated by spline interpolation.

* * * * *